US009838776B2

(12) United States Patent
Broadley et al.

(10) Patent No.: US 9,838,776 B2
(45) Date of Patent: Dec. 5, 2017

(54) RESTRICTED BALL AND SOCKET JOINT FOR HEADSET EARCUP

(71) Applicant: Sonetics Holdings, Inc., Vancouver, WA (US)

(72) Inventors: Simon Broadley, West Linn, OR (US); Brian VanderPloeg, Lake Oswego, OR (US); Calvin Toothaker, Portland, OR (US)

( * ) Notice: Subject to any disclaimer, the term of this patent is extended or adjusted under 35 U.S.C. 154(b) by 483 days.

(21) Appl. No.: 14/322,069

(22) Filed: Jul. 2, 2014

(65) Prior Publication Data

US 2016/0007112 A1 Jan. 7, 2016

(51) Int. Cl.
*H04R 1/10* (2006.01)

(52) U.S. Cl.
CPC ..... *H04R 1/1066* (2013.01); *H04R 1/1008* (2013.01); *H04R 1/1083* (2013.01); *H04R 2201/023* (2013.01); *H04R 2410/05* (2013.01)

(58) Field of Classification Search
CPC ..... H04R 1/1066
USPC ..... 381/72, 378, 379; 379/430
See application file for complete search history.

(56) References Cited

U.S. PATENT DOCUMENTS

| | | | | |
|---|---|---|---|---|
| 4,027,113 | A * | 5/1977 | Matsumoto | F16C 11/0661 381/378 |
| 5,446,788 | A * | 8/1995 | Lucey | H04M 1/05 379/430 |
| 5,469,505 | A | 11/1995 | Cattey et al. | |
| 8,213,667 | B2 | 7/2012 | Nelson et al. | |
| 2012/0269374 | A1 | 10/2012 | Lee et al. | |

* cited by examiner

*Primary Examiner* — Md S Elahee
(74) *Attorney, Agent, or Firm* — Keith L. Jenkins, Registered Patent Attorney, LLC; Keith L. Jenkins

(57) ABSTRACT

A ball and socket joint preventing rotation of the ball about the axis of radial symmetry of the socket and restricting rotation of the ball about both axes orthogonal to the axis of radial symmetry to a predetermined angular value. The ball is irregular in shape and has grooves that receive ridges in the socket to accomplish the axial rotational restriction. The interaction of socket shape with ball shape accomplishes the rotational restrictions about the orthogonal axes. An exemplary use is for joining headset ear cups to headset side pieces to provide flexibility to accommodate a wide range of head shapes and sizes. The ball is preferably made of one piece with the headset side pieces and the socket is preferably made of one piece with the shell of the ear cup. Embodiments for head-mounted headsets and helmet-mounted headsets are disclosed.

20 Claims, 17 Drawing Sheets

RESTRICTED BALL AND SOCKET JOINT FOR HEADSET EARCUP

FIELD OF ART

The present invention relates to a ball and socket joint specially adapted for use on a hearing protection or communication headset ear cup. More particularly, the invention relates to a ball and socket joint limited to predetermined limits about the X and Y-axes and zero degrees about the Z-axis and in which the ball can be inserted or removed only by a Z-axis force.

CROSS REFERENCE TO RELATED APPLICATIONS

None.

STATEMENT REGARDING FEDERALLY SPONSORED RESEARCH AND DEVELOPMENT

None.

BACKGROUND OF THE INVENTION

Headsets are widely used in industry for hearing protection, electronic communication, or both. A perennial problem in headset design is finding a way to make a mass-production headset that will fit the wide variety of head sizes and shapes. Headset ear cups that are flexibly attached to headset side pieces must be resistant to disconnecting, have a simple and inexpensive connector, and provide a range of flexibility adequate to adapt to a wide variety of head sizes and shapes. Towards those ends, the present inventors disclose the present novel invention.

SUMMARY OF THE INVENTION

In one embodiment, the invention provides a restricted ball and socket joint for a headset ear cup including: an irregular ball including: a bulb; an axis of radial symmetry; and a plurality of axial external grooves equally spaced apart around the bulb; a socket including: a circular opening having a central axis of rotation; and a plurality of ridges within the circular opening alignable to the plurality of the grooves; and where the irregular ball, when installed in the socket, is restricted from rotating about the central axis of rotation by the plurality of the ridges engaging the plurality of the grooves. The restricted ball and socket joint for a headset ear cup, further including a panel that is one of supporting the socket and of one piece with the socket. The restricted ball and socket joint for a headset ear cup, where the irregular ball further includes: a stem extending between the bulb and an object to be connected by the restricted ball and socket joint; a semi-spherical section extending axially from the stem, where the semi-spherical section includes the largest diameter of the bulb; a truncated conical section extending axially from the semi-spherical section; and a semi-spherical end piece extending axially from the truncated conical section. The restricted ball and socket joint for a headset ear cup, where the semi-spherical end piece of the irregular ball includes an axially aligned concave portion. The restricted ball and socket joint for a headset ear cup, where the socket further includes: a beveled annular edge surrounding the circular opening; an inner opposing beveled surface extending axially from the beveled annular edge; an inner cylindrical surface extending axially from the inner opposing beveled surface; and an inner semi-spherical section extending axially from the inner cylindrical surface. The restricted ball and socket joint for a headset ear cup, where each ridge of the plurality of the ridges have a generally triangular cross-section and taper bi-directionally from a junction of the inner opposing beveled surface and the inner cylindrical surface. The restricted ball and socket joint for a headset ear cup, where the inner cylindrical surface of the socket and the truncated conical section of the ball form a predetermined angle, when the ball is installed in the socket and the axis of radial symmetry of the irregular ball is aligned with the central axis of rotation of the socket, where the predetermined angle determines the limit of rotation of the irregular ball about axes orthogonal to the central axis of rotation of the socket. The restricted ball and socket joint for a headset ear cup, where the predetermined angle is twenty degrees. The restricted ball and socket joint for a headset ear cup, where a first the irregular ball is either connected to a first headset side piece or is of one piece with a first headset side piece. The restricted ball and socket joint for a headset ear cup, where a first the irregular ball is either connected to a first helmet side piece or is of one piece with a first helmet side piece. The restricted ball and socket joint for a headset ear cup, where the socket is either fixed in a shell of a headset ear cup or is of one piece with a shell of a headset ear cup. The restricted ball and socket joint for a headset ear cup, where; a first irregular ball is integral to a first headset side piece at a first end of said first headset side piece; a second irregular ball is integral to a second headset side piece at a first end of said second headset side piece; the first and second headset side pieces are connected by an adjustment band; a first socket is integral with a shell of a first headset ear cup; a second socket is integral with a shell of a second headset ear cup; the first irregular ball is installed in the first socket; and the second irregular ball is installed in the second socket to form a headset. The restricted ball and socket joint for a headset ear cup, where the first and second irregular balls are installed in the first and second sockets, respectively, only in discrete positions determined by the number and spacing of the grooves and the ridges. The restricted ball and socket joint for a headset ear cup, where; a first the irregular ball is integral with a first helmet headset side piece at a first end of the first helmet headset side piece; a second the irregular ball is integral with a second helmet headset side piece at a first end of second helmet headset side piece; the first and second helmet headset side pieces are connected to first and second bent supports, respectively, that are coupled to first and second helmet couplings, respectively, that are coupled to first and second opposing helmet attachment points, respectively, on a helmet; a first the socket is integral with a shell of a first headset ear cup; a second the socket is integral with a shell of a second the headset ear cup; the first irregular ball is installed in the first socket; and the second irregular ball is installed in the second socket to form a helmet headset. The restricted ball and socket joint for a headset ear cup, where the first and second irregular balls are installed in the first and second sockets, respectively, only in discrete positions determined by the number and spacing of the grooves and ridges. The restricted ball and socket joint for a headset ear cup, where the socket further includes: a beveled annular edge surrounding the circular opening; an inner opposing beveled surface extending axially from the beveled annular edge; an inner cylindrical surface extending axially from the inner opposing beveled surface; and an inner semi-spherical section extending axially from the inner cylindrical surface.

In a similar embodiment, the invention provides a restricted ball and socket joint for a headset ear cup including: an irregular ball including: a bulb; a stem extending between the bulb and an object to be connected by the restricted ball and socket joint; an axis of radial symmetry; a plurality of axial external grooves equally spaced apart around the bulb; a semi-spherical section extending axially from the stem, where the semi-spherical section includes the largest diameter of the bulb; a truncated conical section extending axially from the semi-spherical section; and a semi-spherical end piece extending axially from the truncated conical section; a socket including: a panel; a circular opening in the panel having a central axis of rotation; a beveled annular edge of the panel surrounding the circular opening; an inner opposing beveled surface extending axially from the beveled annular edge; an inner cylindrical surface extending axially from the inner opposing beveled surface; an inner semi-spherical section extending axially from the inner cylindrical surface; a plurality of ridges within the circular opening where each ridge of the plurality of ridges includes: a triangular cross-section; extension from the inner opposing beveled surface and the inner cylindrical surface; a bidirectional taper extending from a junction of the inner opposing beveled surface and the inner cylindrical surface; the plurality of ridges alignable to the plurality of the grooves; where the irregular ball, when installed in the socket, is restricted from rotating about the central axis of rotation by the plurality of the ridges engaging the plurality of the grooves; where the irregular ball is installed in the socket only in discrete positions determined by the number and spacing of the grooves and ridges; and where the inner cylindrical surface of the socket and the truncated conical section of the ball form a predetermined angle, when the ball is installed in the socket and the axis of radial symmetry of the irregular ball is aligned with the central axis of rotation of the socket, where the predetermined angle determines the limit of rotation of the irregular ball about axes orthogonal to the central axis of rotation of the socket. The restricted ball and socket joint for a headset ear cup, further including EITHER: the headset ear cup, further including: a first irregular ball is integral with a first headset side piece at a first end of the first headset side piece; a second irregular ball is integral with a second headset side piece at a first end of the second headset side piece; the first and second headset side pieces are connected by an adjustment band; a first socket is integral with a shell of a first headset ear cup; a second socket is integral with a shell of a second headset ear cup; the first irregular ball is installed in the first socket; the second irregular ball is installed in the second socket to form a headset; and where the first and second irregular balls are installed in the first and second sockets, respectively, only in discrete positions determined by the number and spacing of the grooves and ridges; OR the headset ear cup, further including: a first irregular ball integral with a first helmet headset side piece at a first end of said first helmet headset side piece; a second the irregular ball is integral with a second helmet headset side piece at a first end of said second helmet headset side piece; the first and second helmet headset side pieces are connected to first and second bent supports, respectively, that are coupled to first and second helmet couplings, respectively, that are coupled to first and second opposing helmet attachment points, respectively, on a helmet; a first socket is integral with a shell of a first the headset ear cup; a second socket is integral with a shell of a second the headset ear cup; the first irregular ball is installed in the first socket; the second irregular ball is installed in the second socket to form a helmet headset; and where the first and second irregular balls are installed in the first and second sockets, respectively, only in discrete positions determined by the number and spacing of the grooves and ridges.

In another similar embodiment, the invention provides a restricted ball and socket joint for a headset ear cup including: an irregular ball including: a bulb; a stem extending between the bulb and an object to be connected by the restricted ball and socket joint; an axis of radial symmetry; a plurality of axial external grooves equally spaced apart around the bulb; a semi-spherical section extending axially from the stem, where the semi-spherical section includes the largest diameter of the bulb; a truncated conical section extending axially from the semi-spherical section; and a semi-spherical end piece extending axially from the truncated conical section; a socket including: a panel; a circular opening in the panel having a central axis of rotation; a beveled annular edge of the panel surrounding the circular opening; an inner opposing beveled surface extending axially from the beveled annular edge; an inner cylindrical surface extending axially from the inner opposing beveled surface; an inner semi-spherical section extending axially from the inner cylindrical surface; a plurality of ridges within the circular opening where each ridge of the plurality of ridges includes: a triangular cross-section; extension from the inner opposing beveled surface and the inner cylindrical surface; a bidirectional taper extending from a junction of the inner opposing beveled surface and the inner cylindrical surface; the plurality of ridges alignable to the plurality of the grooves; where the irregular ball, when installed in the socket, is restricted from rotating about the central axis of rotation by the plurality of the ridges engaging the plurality of the grooves; where the irregular ball is installed in the socket only in discrete positions determined by the number and spacing of the grooves and ridges; and where the inner cylindrical surface of the socket and the truncated conical section of the ball form a predetermined angle, when the ball is installed in the socket and the axis of radial symmetry of the irregular ball is aligned with the central axis of rotation of the socket, where the predetermined angle determines the limit of rotation of the irregular ball about axes orthogonal to the central axis of rotation of the socket. The restricted ball and socket joint for a headset ear cup, where the semi-spherical end piece of the irregular ball includes an axially aligned concave portion.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

As used and defined herein, the term "integral" means "of one piece with or, in an additional embodiment, assembled with".

Figure 1A:
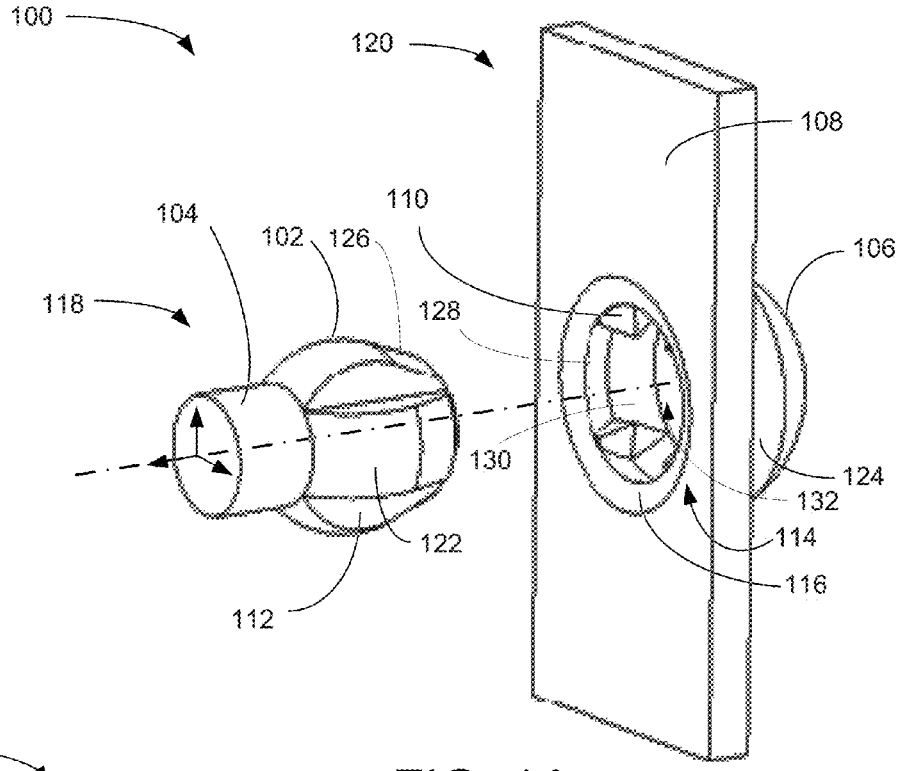
FIG. 1A is a perspective view illustrating an exemplary embodiment of the restricted ball and socket joint for headset ear cup, according to a preferred embodiment of the present invention.

FIG. 1A is a perspective view illustrating an exemplary embodiment of the restricted ball and socket joint for headset ear cup 100, according to a preferred embodiment of the present invention. Irregular ball 118 is sized and shaped to be inserted into socket 120. Irregular ball 118 has a bulb 102 that has four axial grooves 112 (one of two visible of four labeled) circumferentially dispersed at even intervals and a stem 104, which will typically extend between the bulb 102 and another device (not shown in this view) which is integral (preferably of one piece) with the stem 104. Between grooves 112 on the bulb 102, a semi-spherical section 122 extends axially from the stem 104 to a truncated conical section 126. Irregular ball 118 is preferably made of a hard plastic with some resilience and is preferably made by injection molding. In various other embodiments, other materials and forming methods may be used.

Socket 120 includes support panel 108 having an opening 114 surrounded by a beveled ring 116. Preferably, socket 120 is integral with support panel 108. Interior to the beveled ring 116 is a concentric and oppositely beveled section 128 extending from the beveled ring 116 to inner cylindrical section 130. Extending across the oppositely beveled section 128 and the inner cylindrical section 130 in four places (two visible) are ridges 110 (one of two visible labeled) which align with grooves 112 during insertion of ball 118 and during operation of the restricted ball and socket joint for headset ear cup 100. The exterior of socket 120 has an outer cylindrical section 124 that is not coextensive with inner cylindrical section 130. An external semi-spherical section 106 extends in the negative Z-axis direction (see FIG. 1B) from outer cylindrical section 124 to close the back of the socket 120. External semi-spherical section 106 has an interior concentric and coextensive inner semi-spherical section 132.

Panel 108 is shown as a rectangular solid but the invention is not so limited: panel 108 may be of any shape adequate to provide support around opening 114. In a preferred embodiment, the entire socket 120 and panel 108 is formed of a single piece, preferably of injection molded plastic.

Figure 1B:
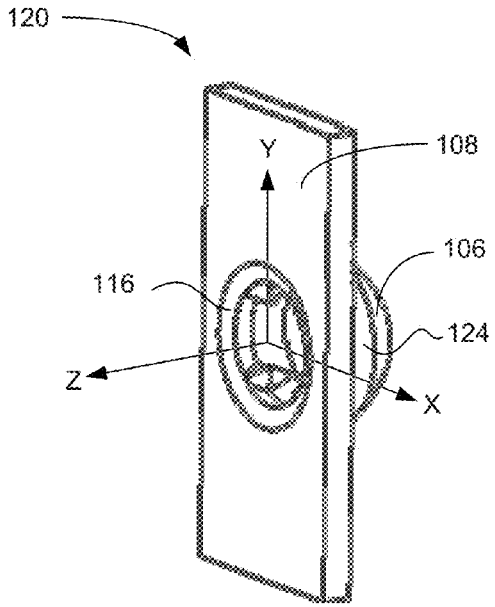
FIG. 1B is a perspective view illustrating an exemplary embodiment of the socket of the restricted ball and socket joint for headset ear cup, according to a preferred embodiment of the present invention.

FIG. 1B is a perspective view illustrating an exemplary embodiment of the socket 120 of the restricted ball and socket joint for headset ear cup 100, according to a preferred embodiment of the present invention. The X, Y, and Z axes which will be referenced throughout this specification and in the claims are shown in relation to socket 120. The origin is generally at the center of rotation of the irregular ball 118, when installed, but the axes are shown outside the socket 120 for simplicity of the drawing. The axes are lettered on their positive ends. The Z-axis is along the central axis of radial symmetry of the beveled ring 116, oppositely beveled section 128, and the inner cylindrical section 130. The alignment of ridges 110 with grooves 112 prevents the ball 118 from rotating about the Z-axis when the irregular ball 118 is installed in socket 120.

Figure 2:
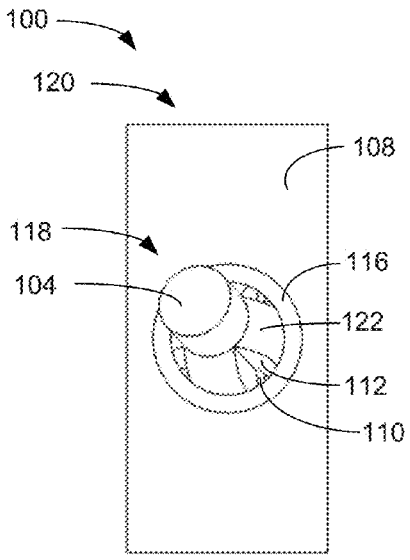
FIG. 2 is a front elevation view illustrating an exemplary embodiment of the restricted ball and socket joint for headset ear cup of FIG. 1A in a first exemplary configuration, according to a preferred embodiment of the present invention.

FIG. 2 is a front elevation view illustrating an exemplary embodiment of the restricted ball and socket joint for headset ear cup 100 of FIG. 1A in a first exemplary configuration, according to a preferred embodiment of the present invention. Irregular ball 118 is shown installed in socket 120 and rotated minus twenty degrees about the X-axis, minus twenty degrees about the Y-axis, and zero degrees about the Z-axis. Rotation about X and Y axes are preferably restricted to plus and minus twenty degrees, as the present inventors have found that these limits comfortably accommodate the wide variety of head shapes among users. In various additional embodiments, other limits may be used.

Figure 3:
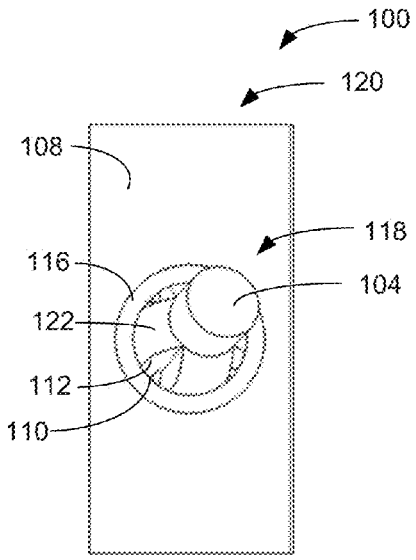
FIG. 3 is a front elevation view illustrating an exemplary embodiment of the restricted ball and socket joint for headset ear cup of FIG. 1A in a second exemplary configuration, according to a preferred embodiment of the present invention.

FIG. 3 is a front elevation view illustrating an exemplary embodiment of the restricted ball and socket joint for headset ear cup 100 of FIG. 1A in a second exemplary configuration, according to a preferred embodiment of the present invention. Irregular ball 118 is shown installed in socket 120 and rotated minus twenty degrees about the X-axis, twenty degrees about the Y-axis, and zero degrees about the Z-axis. The cases shown in FIGS. 2-5 are limiting cases, and positions resulting from rotations within the plus and minus twenty degrees restrictions are both possible and more typical in actual use.

Figure 4:
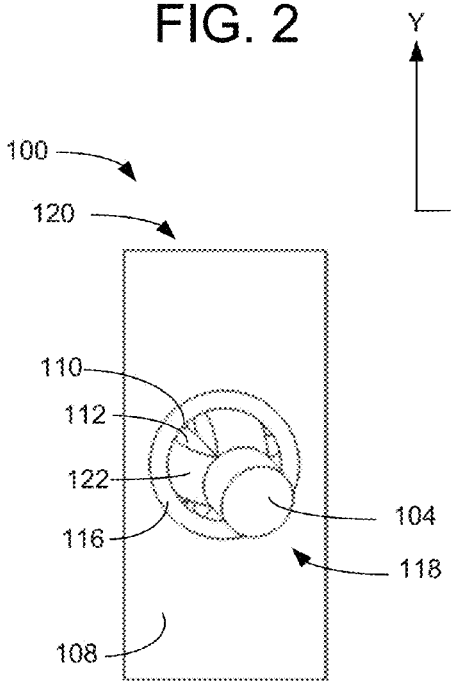
FIG. 4 is a front elevation view illustrating an exemplary embodiment of the restricted ball and socket joint for headset ear cup of FIG. 1A in a third exemplary configuration, according to a preferred embodiment of the present invention.

FIG. 4 is a front elevation view illustrating an exemplary embodiment of the restricted ball and socket joint for headset ear cup 100 of FIG. 1A in a third exemplary configuration, according to a preferred embodiment of the present invention. Irregular ball 118 is shown installed in socket 120 and rotated twenty degrees about the X-axis, twenty degrees about the Y-axis, and zero degrees about the Z-axis.

Figure 5:
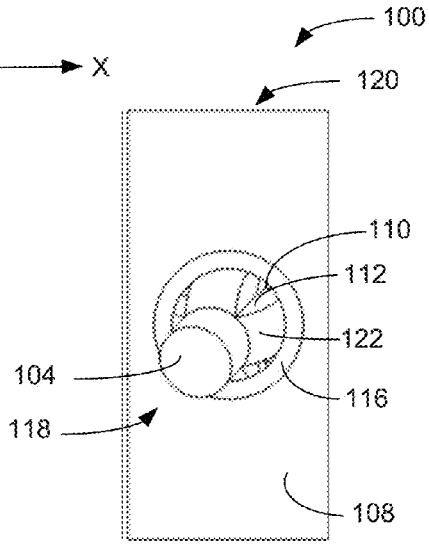
FIG. 5 is a front elevation view illustrating an exemplary embodiment of the restricted ball and socket joint for headset ear cup of FIG. 1A in a fourth exemplary configuration, according to a preferred embodiment of the present invention

FIG. 5 is a front elevation view illustrating an exemplary embodiment of the restricted ball and socket joint for headset ear cup 100 of FIG. 1A in a fourth exemplary configuration, according to a preferred embodiment of the present invention. Irregular ball 118 is shown installed in socket 120 and rotated twenty degrees about the X-axis, minus twenty degrees about the Y-axis, and zero degrees about the Z-axis.

Figure 6:
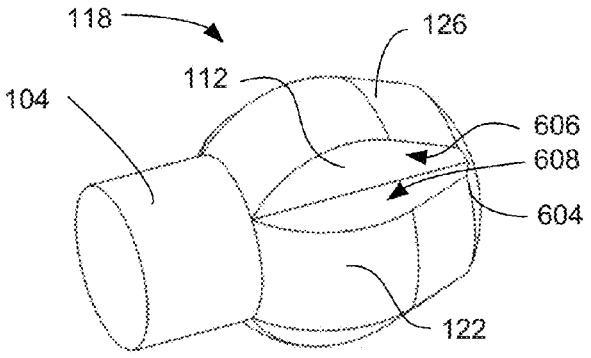
FIG. 6 is a perspective view illustrating an exemplary embodiment of the irregular ball of the restricted ball and socket joint for headset ear cup of FIG. 1A, according to a preferred embodiment of the present invention.

FIG. 6 is a perspective view illustrating an exemplary embodiment of the irregular ball 118 of the restricted ball and socket joint for headset ear cup 100 of FIG. 1A, according to a preferred embodiment of the present invention. Semi-spherical end piece 604 extends from truncated conical section 126. Each groove 112 has a horizontal surface 608 and a vertical surface 606. The stem 104 is illustrated as a cylindrical solid, but the invention is not so limited. Stem 102 is preferably molded as one piece with an object, such as a headset side piece 1600 (see FIG. 16) or a helmet mounted side piece 1800, and any shape or extent that is functional for such purposes is within the scope of the present invention. In addition, various other ball and socket applications in which rotations about the X and Y axes are limited and rotation about the Z-axis is prevented are within the scope of the invention, and any stem 102 shape or extent functional for those purposes is within the scope of the present invention as well.

Figure 7:
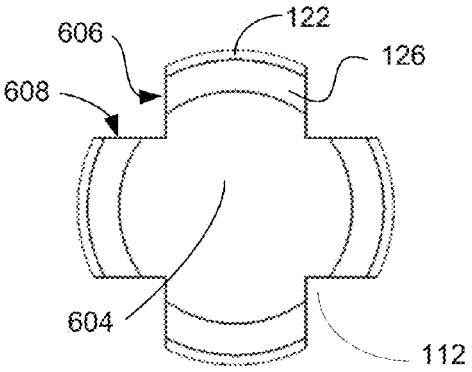
FIG. 7 is a front elevation view illustrating an exemplary embodiment of the irregular ball of the restricted ball and socket joint for headset ear cup of FIG. 1A, according to a preferred embodiment of the present invention.

FIG. 7 is a front elevation view illustrating an exemplary embodiment of the irregular ball 118 of the restricted ball and socket joint for headset ear cup 100 of FIG. 1A, according to a preferred embodiment of the present invention. Semi-spherical end piece 604 moves slidingly and rotationally along the inner semi-spherical section 132. Grooves 112 have perpendicular surfaces 606 and 608.

Figure 8:
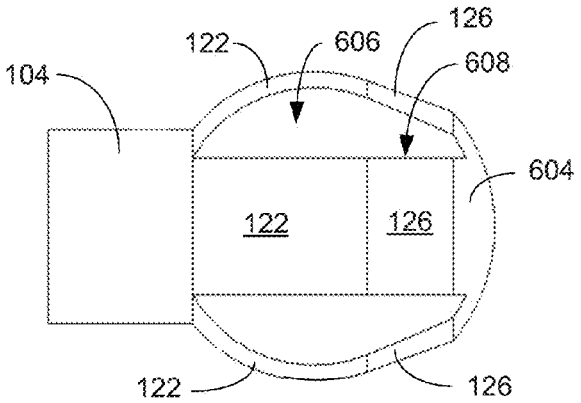
FIG. 8 is a front elevation view illustrating an exemplary embodiment of the irregular ball of the restricted ball and socket joint for headset ear cup of FIG. 1A, according to a preferred embodiment of the present invention.

FIG. 8 is a front elevation view illustrating an exemplary embodiment of the irregular ball 118 of the restricted ball and socket joint for headset ear cup 100 of FIG. 1A, according to a preferred embodiment of the present invention. Semi-spherical end piece 604 can be most clearly seen in this view. The largest diameter of irregular ball 118 is within the semi-spherical section 122. The truncated conical section 126 can also be most clearly seen in this view. Truncated conical section 126 tapers from the semi-spherical section 122 to the semi-spherical end piece 604.

Figure 9A:
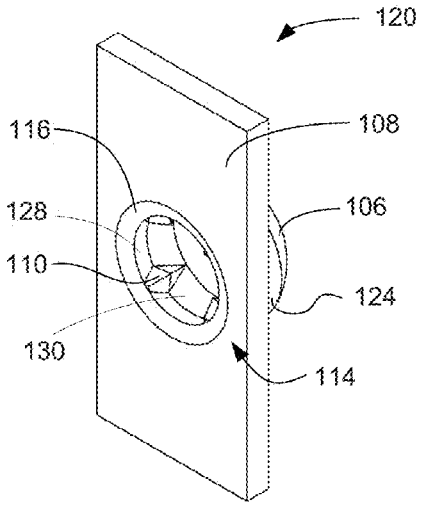
FIG. 9A is a perspective view illustrating an exemplary embodiment of a socket of the restricted ball and socket joint for headset ear cup of FIG. 1A, according to a preferred embodiment of the present invention.

FIG. 9A is a perspective view illustrating an exemplary embodiment of a socket 120 of the restricted ball and socket joint for headset ear cup 100 of FIG. 1A, according to a preferred embodiment of the present invention. Ridges 110 are tapered from the boundary between oppositely beveled section 128 and inner cylindrical section 130 to both the inner semi-spherical section 132 and, oppositely, to the beveled ring 116.

Figure 9B:
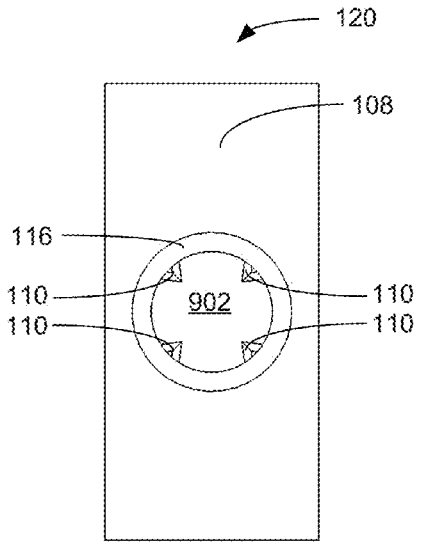
FIG. 9B is a front elevation view illustrating an exemplary embodiment of a socket of the restricted ball and socket joint for headset ear cup of FIG. 1A, according to a preferred embodiment of the present invention.

FIG. 9B is a front elevation view illustrating an exemplary embodiment of a socket 120 of the restricted ball and socket joint for headset ear cup 100 of FIG. 1A, according to a preferred embodiment of the present invention. Ridges 110 are slightly truncated at the boundary between the beveled ring 116 and the oppositely beveled section 128, as will be discusses in more detail in regard to FIG. 12.

Figure 9C:
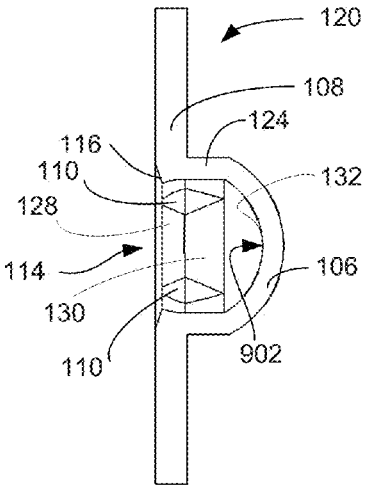
FIG. 9C is a side elevation view illustrating an exemplary embodiment of a socket of the restricted ball and socket joint for headset ear cup of FIG. 1A, according to a preferred embodiment of the present invention.

FIG. 9C is a side elevation view illustrating an exemplary embodiment of a socket 1200 of the restricted ball and socket joint for headset ear cup 100 of FIG. 1A, according to a preferred embodiment of the present invention. The dual taper of ridges 110 and the slight truncation of ridges 110 can be most clearly seen in this view. Inner semi-spherical section 132 has an inner semi-spherical surface 902, which is preferably a low-friction surface.

Figure 9D:
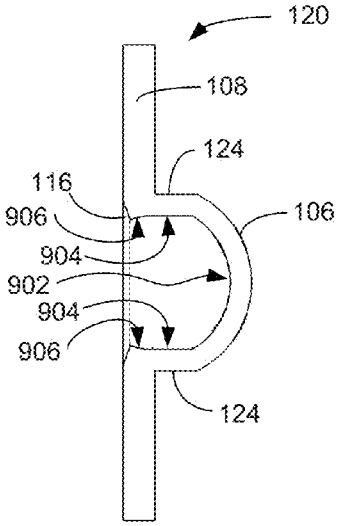
FIG. 9D is a side elevation view illustrating an exemplary embodiment of a socket of the restricted ball and socket joint for headset ear cup of FIG. 1A, according to a preferred embodiment of the present invention.

FIG. 9D is a side elevation view illustrating an exemplary embodiment of a socket 120 of the restricted ball and socket joint for headset ear cup 100 of FIG. 1A, according to a preferred embodiment of the present invention. The inner cylindrical surface 904 of the inner cylindrical section 130 need not be a low-friction surface, as will be seen in discussion below. The retaining surface 906 of oppositely beveled section 128 is preferably a low-friction surface, as removal of the irregular ball 118 from the socket 120 requires sliding on retaining surface 906 and deformation of the ridge between the beveled ring 116 and the oppositely beveled section 128.

Figure 10A:
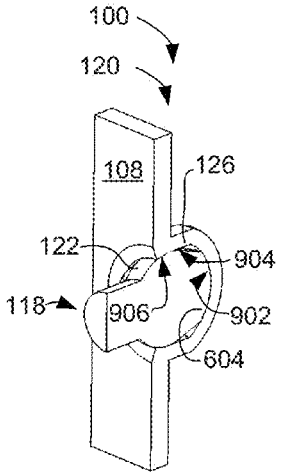
FIG. 10A is a perspective cutaway view illustrating an exemplary embodiment of the restricted ball and socket joint for headset ear cup of FIG. 1A, according to a preferred embodiment of the present invention.

FIG. 10A is a perspective cutaway view illustrating an exemplary embodiment of the restricted ball and socket joint for headset ear cup 100 of FIG. 1A, according to a preferred embodiment of the present invention. The maximum diameter of semi-spherical section 122 is located behind the ridge between the beveled ring 116 and the oppositely beveled section 128 and so irregular ball 118 is retained by the ridge between the beveled ring 116 and the oppositely beveled section 128. The surface of semi-spherical section 122 engages a portion of inner cylindrical surface 904. Semi-spherical end piece 604 slidingly engages inner semi-spherical surface 902 of inner semi-spherical section 132.

Figure 10B:
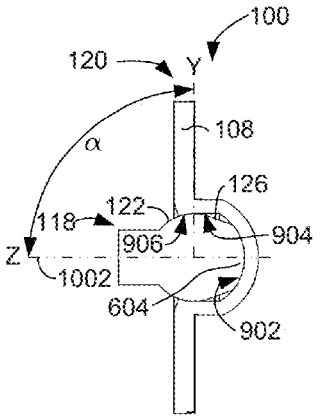
FIG. 10B is a side elevation cross-sectional view illustrating an exemplary embodiment of the restricted ball and socket joint for headset ear cup of FIG. 1A in a first orientation, according to a preferred embodiment of the present invention.

FIG. 10B is a side elevation cross-sectional view illustrating an exemplary embodiment of the restricted ball and socket joint for headset ear cup 100 of FIG. 1A in a first orientation, according to a preferred embodiment of the present invention. The longitudinal axis 1002 of the irregular ball 118 is coincident with the Z-axis, making an angle $\alpha$=ninety degrees with the Y-axis.

Figure 10C:
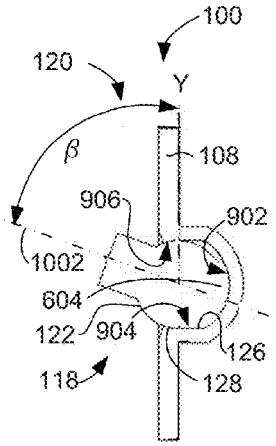
FIG. 10C is a side elevation cross-sectional view illustrating an exemplary embodiment of the restricted ball and socket joint for headset ear cup of FIG. 1A in a second orientation, according to a preferred embodiment of the present invention.

FIG. 10C is a side elevation cross-sectional view illustrating an exemplary embodiment of the restricted ball and socket joint for headset ear cup 100 of FIG. 1A in a second orientation, according to a preferred embodiment of the present invention. The longitudinal axis 1002 of the irregular ball 118 is rotated a negative twenty degrees about the X-axis, making an angle $\beta$=seventy degrees with the Y-axis. Oppositely beveled section 128 of irregular ball 118 engages retaining surface 906 of socket 120. Semi-spherical end piece 604 of irregular ball 118 engages inner semi-spherical surface 902 of socket 120. Truncated conical section 126 engages inner cylindrical surface 904, restricting further negative rotation about the X axis.

Figure 10D:
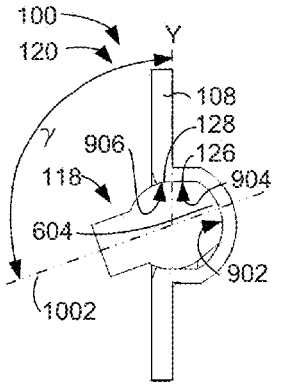
FIG. 10D is a side elevation cross-sectional view illustrating an exemplary embodiment of the restricted ball and socket joint for headset ear cup of FIG. 1A in a third orientation, according to a preferred embodiment of the present invention.

FIG. 10D is a side elevation cross-sectional view illustrating an exemplary embodiment of the restricted ball and socket joint for headset ear cup 100 of FIG. 1A in a third orientation, according to a preferred embodiment of the present invention. The longitudinal axis 1002 of the irregular ball 118 is rotated twenty degrees about the X-axis, making an angle γ=one hundred and ten degrees with the Y-axis. Oppositely beveled section 128 of irregular ball 118 engages retaining surface 906 of socket 120. Semi-spherical end piece 604 of irregular ball 118 engages inner semi-spherical surface 902 of socket 120. Truncated conical section 126 engages inner cylindrical surface 904, restricting further positive rotation about the X axis.

Figure 11A:
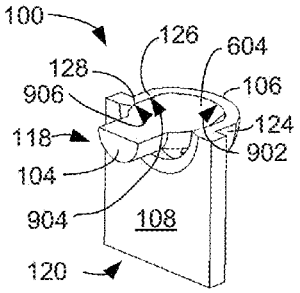
FIG. 11A is a perspective cutaway view illustrating an exemplary embodiment of the restricted ball and socket joint for headset ear cup of FIG. 1A, according to a preferred embodiment of the present invention.

FIG. 11A is a perspective cutaway view illustrating an exemplary embodiment of the restricted ball and socket joint for headset ear cup 100 of FIG. 1A, according to a preferred embodiment of the present invention. Irregular ball 118 is shown without rotation within socket 118. Semi-spherical end piece 604 of irregular ball 118 slidingly and rotationally engages inner semi-spherical surface 902 of socket 120. Truncated conical section 126 of irregular ball 118 engages inner cylindrical surface 904 of socket 120. Semi-spherical section 122 of irregular ball 118 engages retaining surface 906 of socket 120.

Figure 11B:
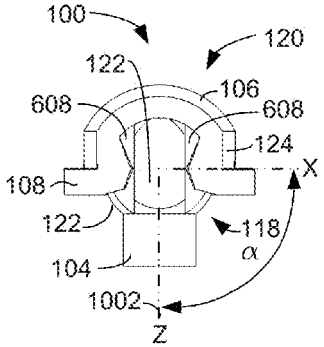
FIG. 11B is a side elevation cross-sectional view illustrating an exemplary embodiment of the restricted ball and socket joint for headset ear cup of FIG. 1A in a first orientation, according to a preferred embodiment of the present invention.

FIG. 11B is a side elevation cross-sectional view illustrating an exemplary embodiment of the restricted ball and socket joint for headset ear cup 100 of FIG. 1A in a first orientation, according to a preferred embodiment of the present invention. The longitudinal axis 1002 of the irregular ball 118 is coincident with the Z-axis, making an angle α=ninety degrees with the X-axis. As sections 126, 128, and semi-spherical end piece 604 are solids of rotation, and as socket inner surfaces 902, 904, and 906 are all surfaces of rotation, the engagement of sections 126, 128, and semi-spherical end piece 604 of irregular ball 118 with surfaces 902, 904, and 906 of socket 120, are similar to those for FIG. 10B, except for a rotation about the Y-axis in this case.

Figure 11C:
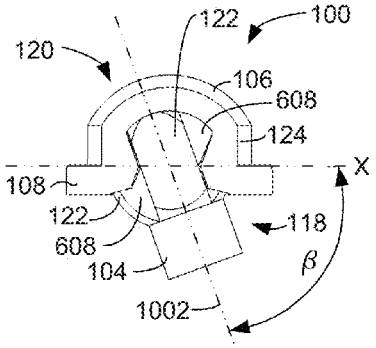
FIG. 11C is a side elevation cross-sectional view illustrating an exemplary embodiment of the restricted ball and socket joint for headset ear cup of FIG. 1A in a second orientation, according to a preferred embodiment of the present invention.

FIG. 11C is a side elevation cross-sectional view illustrating an exemplary embodiment of the restricted ball and socket joint for headset ear cup 100 of FIG. 1A in a second orientation, according to a preferred embodiment of the present invention. The longitudinal axis 1002 of the irregular ball 118 is rotated twenty degrees about the Y-axis, making an angle β=seventy degrees with the X-axis. As sections 126, 128, and semi-spherical end piece 604 are solids of rotation, and as socket inner surfaces 902, 904, and 906 are all surfaces of rotation, the engagement of sections 126, 128, and semi-spherical end piece 604 of irregular ball 118 with surfaces 902, 904, and 906 of socket 120, are similar to those for FIG. 10C, except for a rotation about the Y-axis in this case.

Figure 11D:
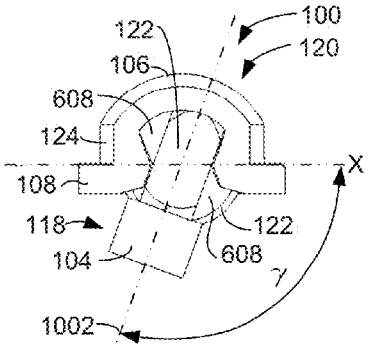
FIG. 11D is a side elevation cross-sectional view illustrating an exemplary embodiment of the restricted ball and socket joint for headset ear cup of FIG. 1A in a third orientation, according to a preferred embodiment of the present invention.

FIG. 11D is a side elevation cross-sectional view illustrating an exemplary embodiment of the restricted ball and socket joint for headset ear cup 100 of FIG. 1A in a third orientation, according to a preferred embodiment of the present invention. The longitudinal axis 1002 of the irregular ball 118 is rotated twenty degrees about the Y-axis, making an angle γ=one hundred and ten degrees with the X-axis. As sections 126, 128, and semi-spherical end piece 604 are solids of rotation, and as socket inner surfaces 902, 904, and 906 are all surfaces of rotation, the engagement of sections 126, 128, and semi-spherical end piece 604 of irregular ball 118 with surfaces 902, 904, and 906 of socket 120, are similar to those for FIG. 10D, except for a rotation about the Y-axis in this case.

Figure 12A:
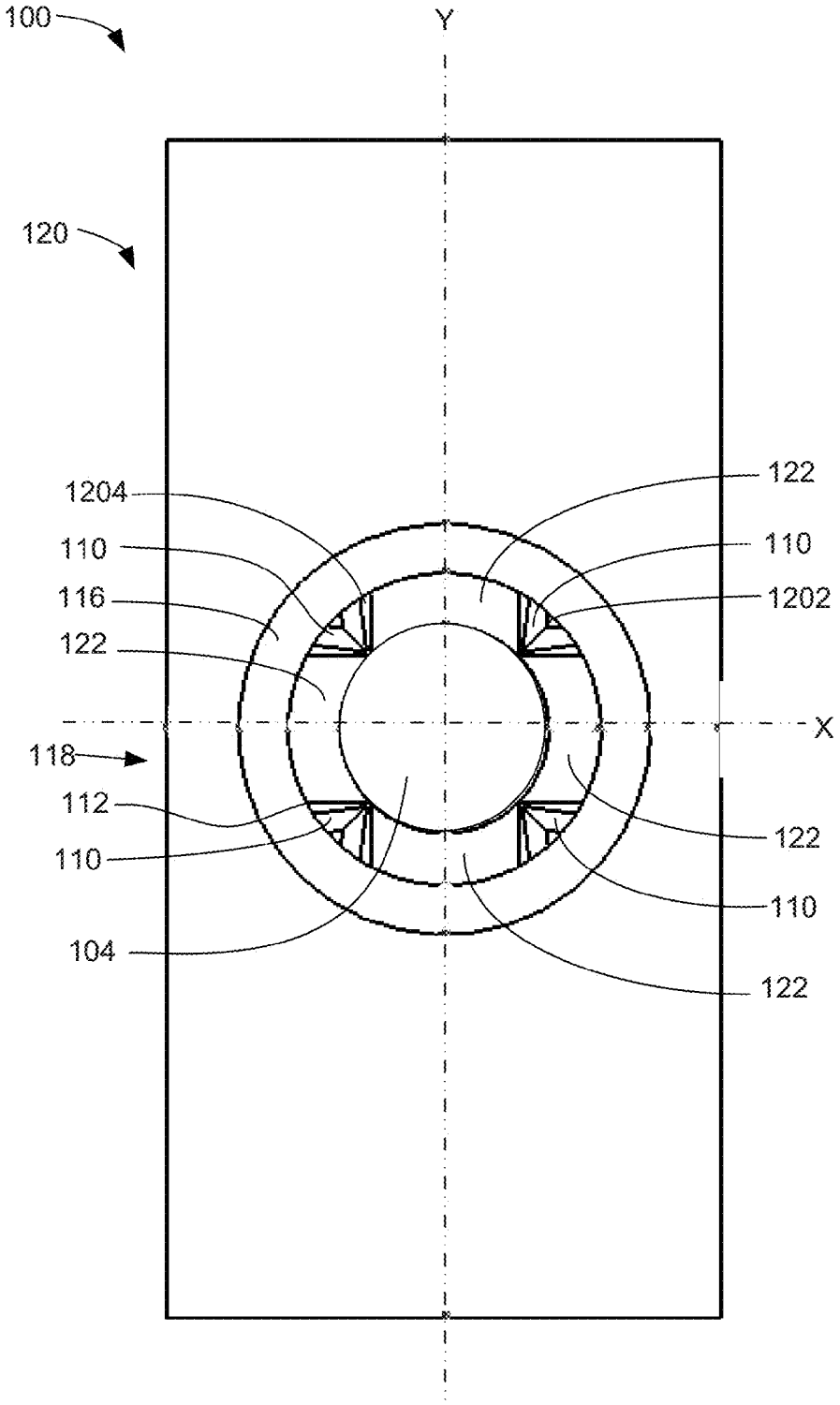
FIG. 12A is a front elevation view illustrating an exemplary embodiment of a socket of the restricted ball and socket joint for headset ear cup of FIG. 1A, according to a preferred embodiment of the present invention.

FIG. 12A is a front elevation view illustrating an exemplary embodiment of a socket 120 of the restricted ball and socket joint for headset ear cup 100 of FIG. 1A, according to a preferred embodiment of the present invention. FIG. 12 best shows the truncation 1202 (one of four labeled) of the ridges 110 and the clearances 1204 (one of eight labeled) between the right-angled grooves 112 and the acutely angled ridges 110.

Figure 12B:
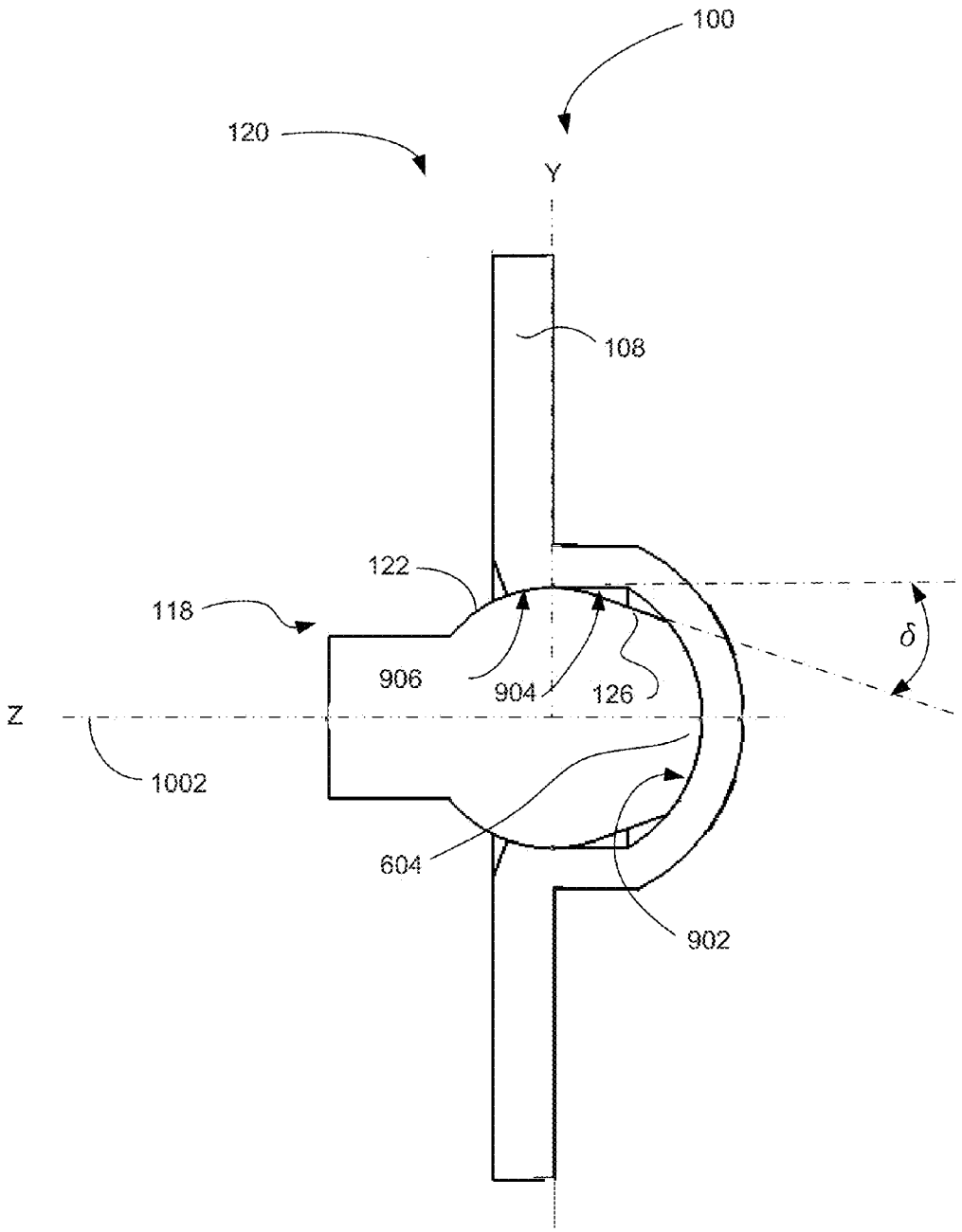
FIG. 12B is a side cross-sectional view illustrating an exemplary embodiment of the restricted ball and socket joint for headset ear cup of FIG. 1A, according to a preferred embodiment of the present invention.

FIG. 12B is a side cross-sectional view illustrating an exemplary embodiment of the restricted ball and socket joint for headset ear cup of FIG. 1A, according to a preferred embodiment of the present invention. Angle δ between inner cylindrical surface 904 of socket 120 and truncated conical section 126 determines the maximum rotation possible about axes that are orthogonal to the Z-axis. When irregular ball 118 is rotated until truncated conical section 126 abuts inner cylindrical surface 904, further rotation is blocked by the abutment.

Figure 13A:
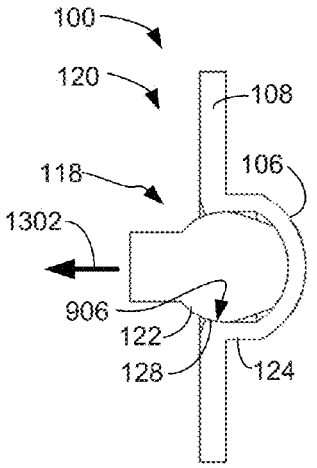
FIG. 13A is a side elevation cross-sectional view illustrating an exemplary embodiment of the restricted ball and socket joint for headset ear cup of FIG. 1A in a first ball extraction step, according to a preferred embodiment of the present invention.

FIG. 13A is a side elevation cross-sectional view illustrating an exemplary embodiment of the restricted ball and socket joint for headset ear cup 100 of FIG. 1A in a first ball extraction step, according to a preferred embodiment of the present invention. Retaining surface 906 of oppositely beveled section 128 of socket 120 engages semi-spherical section 122 of irregular ball 118 as Z-axis linear force 1302 urges axially-oriented irregular ball 118 from socket 120. Z-axis linear force 1302 may be the entire force or a dominant Z-axis component of an off-Z-axis force.

Figure 13B:
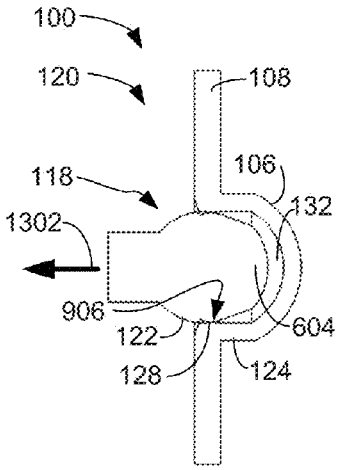
FIG. 13B is a side elevation cross-sectional view illustrating an exemplary embodiment of the restricted ball and socket joint for headset ear cup of FIG. 1A in a second ball extraction step, according to a preferred embodiment of the present invention.

FIG. 13B is a side elevation cross-sectional view illustrating an exemplary embodiment of the restricted ball and socket joint for headset ear cup 100 of FIG. 1A in a second ball extraction step, according to a preferred embodiment of the present invention. Retaining surface 906 of oppositely beveled section 128 of socket 120 deforms and allows semi-spherical section 122 of irregular ball 118 to slide outward as Z-axis linear force 1302 urges Z-axially-oriented irregular ball 118 from socket 120. Semi-spherical end piece 604 has disengaged from inner semi-spherical section 132.

Figure 13C:
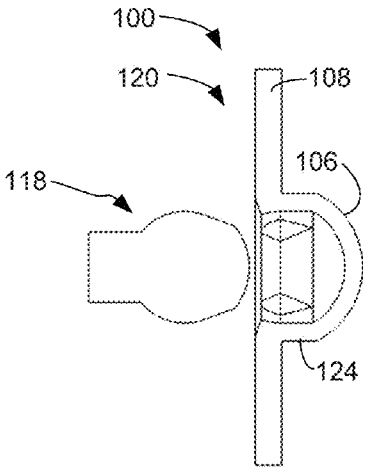
FIG. 13C is a side elevation cross-sectional view illustrating an exemplary embodiment of the restricted ball and socket joint for headset ear cup of FIG. 1A in a third ball extraction step, according to a preferred embodiment of the present invention.

FIG. 13C is a side elevation cross-sectional view illustrating an exemplary embodiment of the restricted ball and socket joint for headset ear cup 100 of FIG. 1A in a third ball extraction step, according to a preferred embodiment of the present invention. Z-axis-oriented Irregular ball 118 is removed from socket 120 by Z-axis linear force 1302.

Figure 14A:
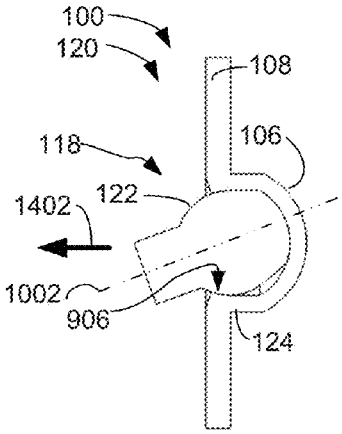
FIG. 14A is a side elevation cross-sectional view illustrating an exemplary embodiment of the restricted ball and socket joint for headset ear cup of FIG. 1A in a first ball extraction step, according to a preferred embodiment of the present invention.

FIG. 14A is a side elevation cross-sectional view illustrating an exemplary embodiment of the restricted ball and socket joint for headset ear cup 100 of FIG. 1A in a first ball extraction step, according to a preferred embodiment of the present invention. Retaining surface 906 of oppositely beveled section 128 of socket 120 engages semi-spherical section 122 of angularly-oriented irregular ball 118 as axial linear force 1402 urges angularly-oriented irregular ball 118 from socket 120.

Figure 14B:
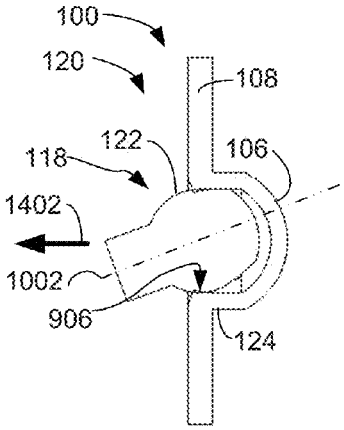
FIG. 14B is a side elevation cross-sectional view illustrating an exemplary embodiment of the restricted ball and socket joint for headset ear cup of FIG. 1A in a second ball extraction step, according to a preferred embodiment of the present invention.

FIG. 14B is a side elevation cross-sectional view illustrating an exemplary embodiment of the restricted ball and socket joint for headset ear cup 100 of FIG. 1A in a second ball extraction step, according to a preferred embodiment of the present invention. Retaining surface 906 of oppositely beveled section 128 of socket 120 deforms and allows semi-spherical section 122 of angularly-oriented irregular ball 118 to slide outward as axial linear force 1402 urges angularly-oriented irregular ball 118 from socket 120. Semi-spherical end piece 604 has disengaged from inner semi-spherical section 132.

Figure 14C:
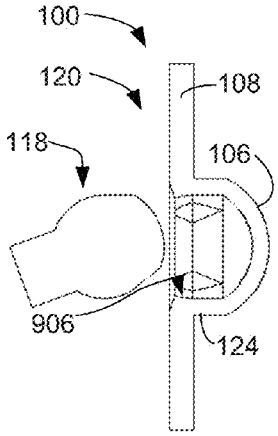
FIG. 14C is a side elevation cross-sectional view illustrating an exemplary embodiment of the restricted ball and socket joint for headset ear cup of FIG. 1A in a third ball extraction step, according to a preferred embodiment of the present invention.

FIG. 14C is a side elevation cross-sectional view illustrating an exemplary embodiment of the restricted ball and socket joint for headset ear cup 100 of FIG. 1A in a third ball extraction step, according to a preferred embodiment of the present invention. Angularly-oriented irregular ball 118 is removed from socket 120 by axial linear force 1402. The teaching of FIGS. 13A-14D is that an axial linear force 1302, 1402 can be used to remove irregular ball 118 from socket 120 regardless of the angular orientation of ball 118. Where the angle of the axis of irregular ball 118 is less than twenty degrees off the Z-axis, then the axial linear force 1302, 1402 may be a dominant component of an off-axis force.

Figure 15A:
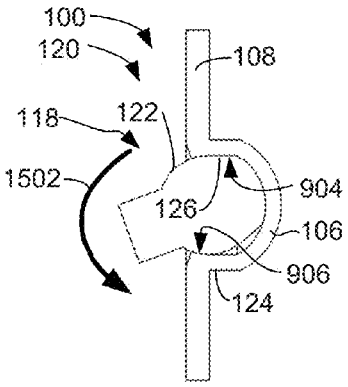
FIG. 15A is a side elevation cross-sectional view illustrating an exemplary embodiment of the restricted ball and socket joint for headset ear cup of FIG. 1A in a first ball resisting step, according to a preferred embodiment of the present invention.

FIG. 15A is a side elevation cross-sectional view illustrating an exemplary embodiment of the restricted ball and socket joint for headset ear cup 100 of FIG. 1A in a first ball resisting step, according to a preferred embodiment of the present invention. Torque 1502 causes truncated conical section 126 of irregular ball 118 to abut and bind inner cylindrical surface 904 of socket 120, preventing further rotation of irregular ball 118 and preventing irregular ball 118 from being extracted from socket 120 by a torque 1502. It will be clear to those of skill in the art, enlightened by the present disclosure, that the plane in which the torque 1502 acts is irrelevant to the result.

Figure 15B:
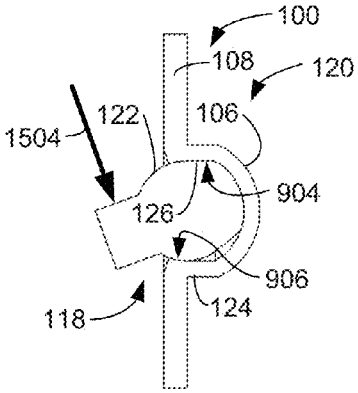
FIG. 15B is a side elevation cross-sectional view illustrating an exemplary embodiment of the restricted ball and socket joint for headset ear cup of FIG. 1A in a second ball resisting step, according to a preferred embodiment of the present invention.

FIG. 15B is a side elevation cross-sectional view illustrating an exemplary embodiment of the restricted ball and socket joint for headset ear cup 100 of FIG. 1A in a second ball resisting step, according to a preferred embodiment of the present invention. Linear off-axial force 1504 has an inward Z-axis component, relative to the socket 120, and a torque component, and so produces the same binding between truncated conical section 126 of irregular ball 118 and inner cylindrical surface 904 of socket 120, preventing further rotation of irregular ball 118 and preventing irregular ball 118 from being extracted from socket 120 by an off-axis force 1504. The teaching of FIGS. 13A to 15B is that the irregular ball 118 successfully resists removal from the socket 120 except in response to a linear Z-axis force 1302 or 1402.

Figure 16:
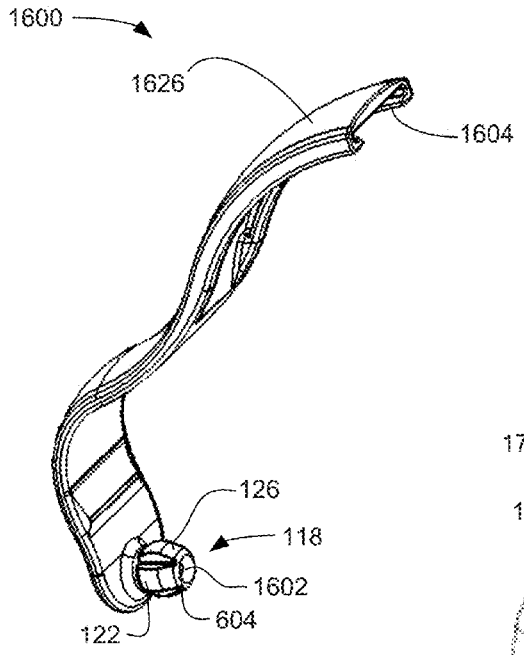
FIG. 16 is a perspective view illustrating an exemplary embodiment of a ball of the restricted ball and socket joint for headset ear cup of FIG. 1A integral to a headset side piece, according to a preferred embodiment of the present invention.

FIG. 16 is a perspective view illustrating an exemplary embodiment 1600 of an irregular ball 118 of the restricted ball and socket joint for headset ear cup 100 of FIG. 1A integral to a headset side piece 1626, according to a preferred embodiment of the present invention. Headset side piece 1626 is one of two headset side pieces 1626 that are used on opposing sides of a headset 1900 (see FIG. 19) and to which ear cups 1700 and 1908 (see FIG. 19) are attached, respectively, via restricted ball and socket joints for headset ear cup 100. Irregular ball 118 is shown with preferred cup end 1602 in semi-spherical end piece 604. Irregular ball 118 is fixed to headset side piece 1626 in a predetermined orientation, preferably with the groove 112 surfaces 608 and 606 horizontal and vertical, respectively, when headset side piece 1626 is in operational position. That is, with grooves 112 at forty-five degree angles from the long axis of the headset side piece 1626. Headset side piece 1626 has a receiver 1604 for an adjustment band 1902 (see FIG. 19), for adjusting the headset 1900 to a comfortable fit. Headset side piece 1626 is preferably made of a hard plastic with some small resilience. Headset side piece 1626 with irregular ball 118 is preferably made of one piece.

Figure 17:
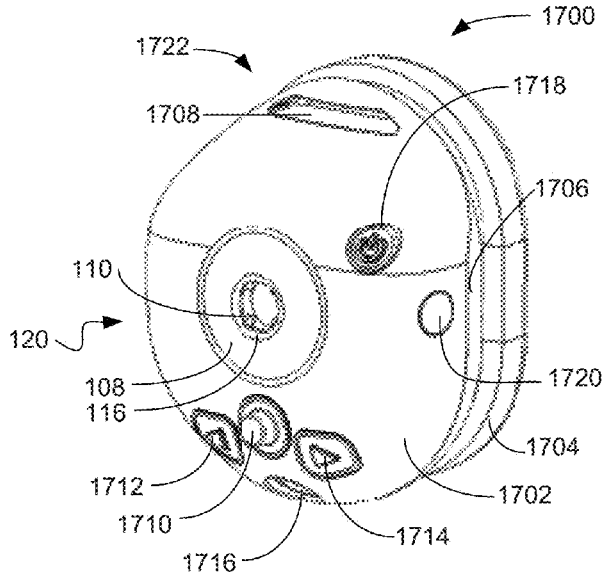
FIG. 17 is a perspective view illustrating an exemplary embodiment of an ear cup having a socket of the restricted ball and socket joint for headset ear cup of FIG. 1A, according to a preferred embodiment of the present invention.

FIG. 17 is a perspective view illustrating an exemplary embodiment of an ear cup having a socket of the restricted ball and socket joint for headset ear cup 100 of FIG. 1A, according to a preferred embodiment of the present invention. Ear cup 1700 is sized and shaped to cover a human ear. Considerable variation as to shape is comprehended within the present invention, within the functional limitation that the ear cup 1700 covers a human ear and supports the electronics needed for operation. Ear cup 1700 has an outer shell 1720 that includes a bottom panel 1706, an upper panel, 1702, and a socket 120. Bottom panel 1706 supports internal electronics (not shown) and top panel 1702. Top panel 1702 supports a push-to-talk (PTT) button 1710, selector switches 1712 and 1714, DC power jack 1716, and fit-detection and/or noise cancellation external microphone 1720, power button 1718, and head strap attachment slot 1708. Socket 120 has a round panel 108 but otherwise conforms to the previous figures for socket 120. Panel 108 may be arcuate. A foam ring 1704 is attached to the edge of shell 1722 and forms the interface between the shell 1722 and the user's head. Foam ring 1704 is preferably closed cell foam and has a weather-resistant covering.

Figure 18:
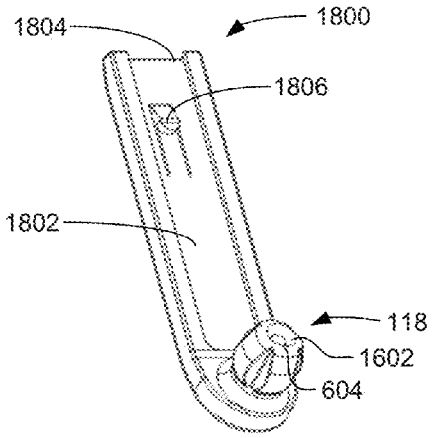
FIG. 18 is a perspective view illustrating an exemplary embodiment of an irregular ball of the restricted ball and socket joint for headset ear cup of FIG. 1A integral to a helmet side piece, according to a preferred embodiment of the present invention.

FIG. 18 is a perspective view illustrating an exemplary embodiment of an irregular ball 118 of the restricted ball and socket joint for headset ear cup 100 of FIG. 1A integral to a helmet headset side piece 1800, according to a preferred embodiment of the present invention. Helmet headset side piece 1800 is one of two helmet headset side pieces 1800 that are used in opposing sides of a helmet headset 2300 (see FIG. 24) and to which ear cups 1700 and 1908 (see FIG. 24) are attached, respectively, via restricted ball and socket joints for headset ear cup 100. Irregular ball 118 is shown with preferred cup end 1602 in semi-spherical end piece 604. Irregular ball 118 is fixed to helmet headset side piece body 1802 in a predetermined orientation, preferably with the groove 112 surfaces 608 and 606 horizontal and vertical, respectively, when headset side piece 1800 is in operational position. That is, with grooves 112 at forty-five degree angles from the long axis of the helmet headset side piece body 1802. Helmet headset side piece 1800 has a receiver 1804 for a helmet attachment band 2308 (see FIG. 24), and a coupling 1806 for securing the helmet headset side piece 1800 to the helmet attachment band 2308 (see FIG. 24). Helmet headset side piece 1800 is preferably made of a hard plastic with some small resilience. Helmet headset side piece 1800 with irregular ball 118 is preferably made of one piece.

Figure 19:
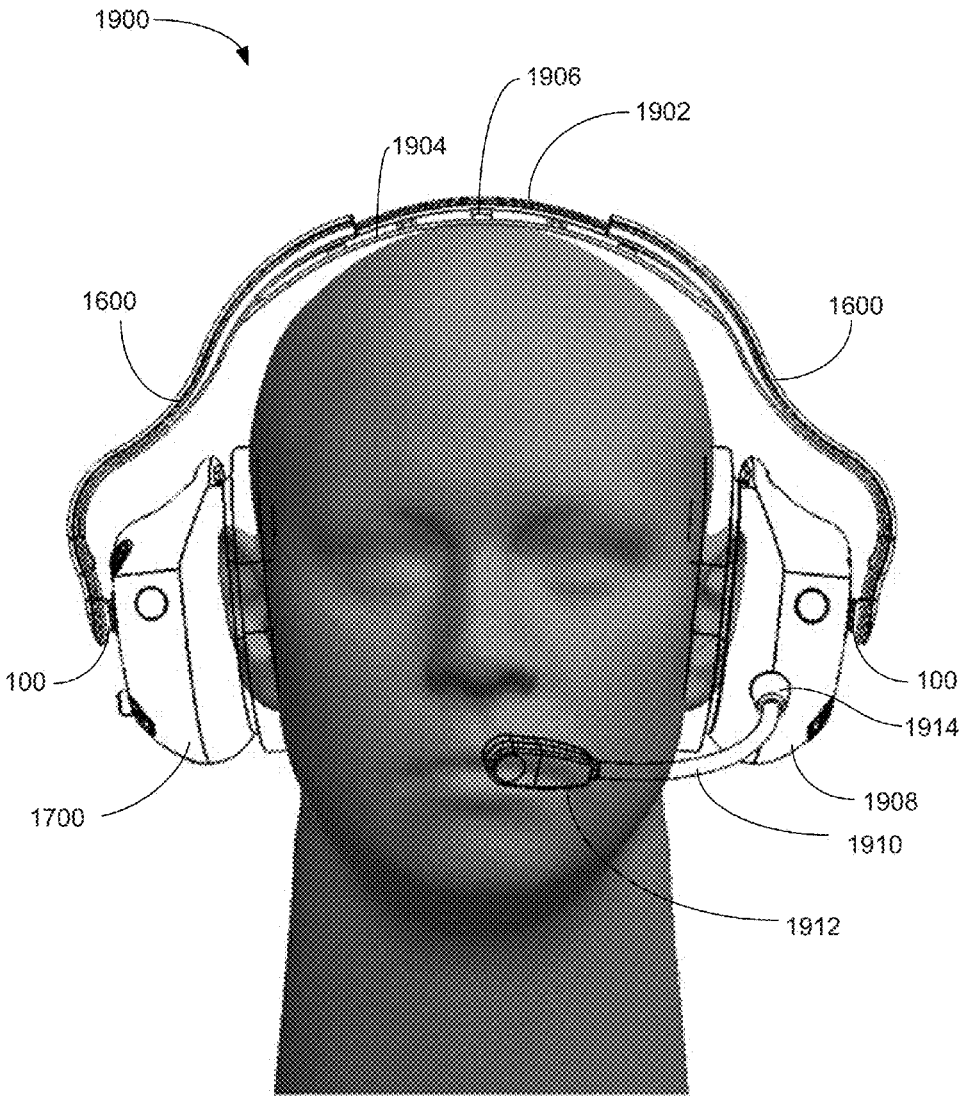
FIG. 19 is a front elevation view illustrating an exemplary embodiment of the restricted ball and socket joint for headset ear cup of FIG. 1A used to form a headset, according to a preferred embodiment of the present invention.

FIG. 19 is a front elevation view illustrating an exemplary embodiment of the restricted ball and socket joint for headset ear cup 100 of FIG. 1A used to form a headset 1900, according to a preferred embodiment of the present invention. Headset 1900 includes ear cup 1700, ear cup 1908 and left and right headset side pieces 1600 coupled to ear cups 1700 and 1908 via restricted ball and socket joints for headset ear cups 100. Left and right headset side pieces 1600 are adjustably connected by adjustment band 1902, which is supported by head band 1904 and cushions 1906. Head band 1904 is preferably a resilient material compatible with contact with the user's head. Ear cup 1908 is substantially the same structure as ear cup 1700, with or without redundant controls, preferably has a mirror-image shape, and supports a noise-cancelling microphone 1912 mounted on boom 1910 extending from fitting 1914 on the shell of ear cup 1908.

The restricted ball and socket joints for headset ear cups 100 enable free movement of the ear cups 1700 and 1908 within plus or minus twenty degrees top-to-bottom and front-to-back, but do not allow the left and right headset side pieces 1600 and adjustment band 1902 to rotate with respect to the ear cups 1700 and 1908. The restricted movement of the restricted ball and socket joints for headset ear cups 100 enables the headset 1900 to comfortable and functionally adapt to a wide variety of head shapes and sizes, while preventing fit problems arising from rotation of the left and right headset side pieces 1600 and adjustment band 1902 relative to ear cups 1700 and 1908.

Figure 20:
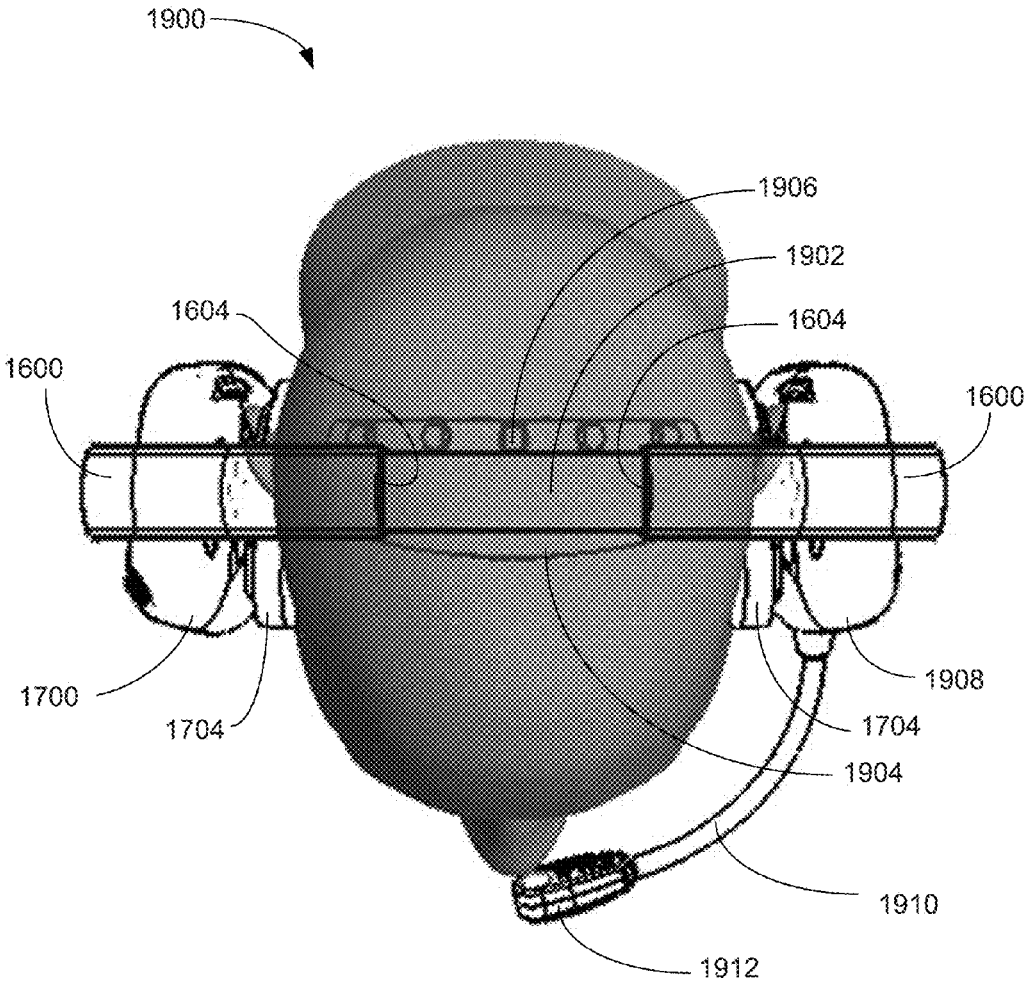
FIG. 20 is a top plan view illustrating an exemplary embodiment of the restricted ball and socket joint for headset ear cup of FIG. 1A used to form a headset, according to a preferred embodiment of the present invention.

FIG. 20 is a top plan view illustrating an exemplary embodiment of the restricted ball and socket joint for headset ear cup 100 of FIG. 1A used to form a headset 1900, according to a preferred embodiment of the present invention. The headband 1904 preferably supports most or all of the weight of the headset 1900, with friction between the foam rings 1704 and the user's head making only a minor contribution, if any.

Figure 21:
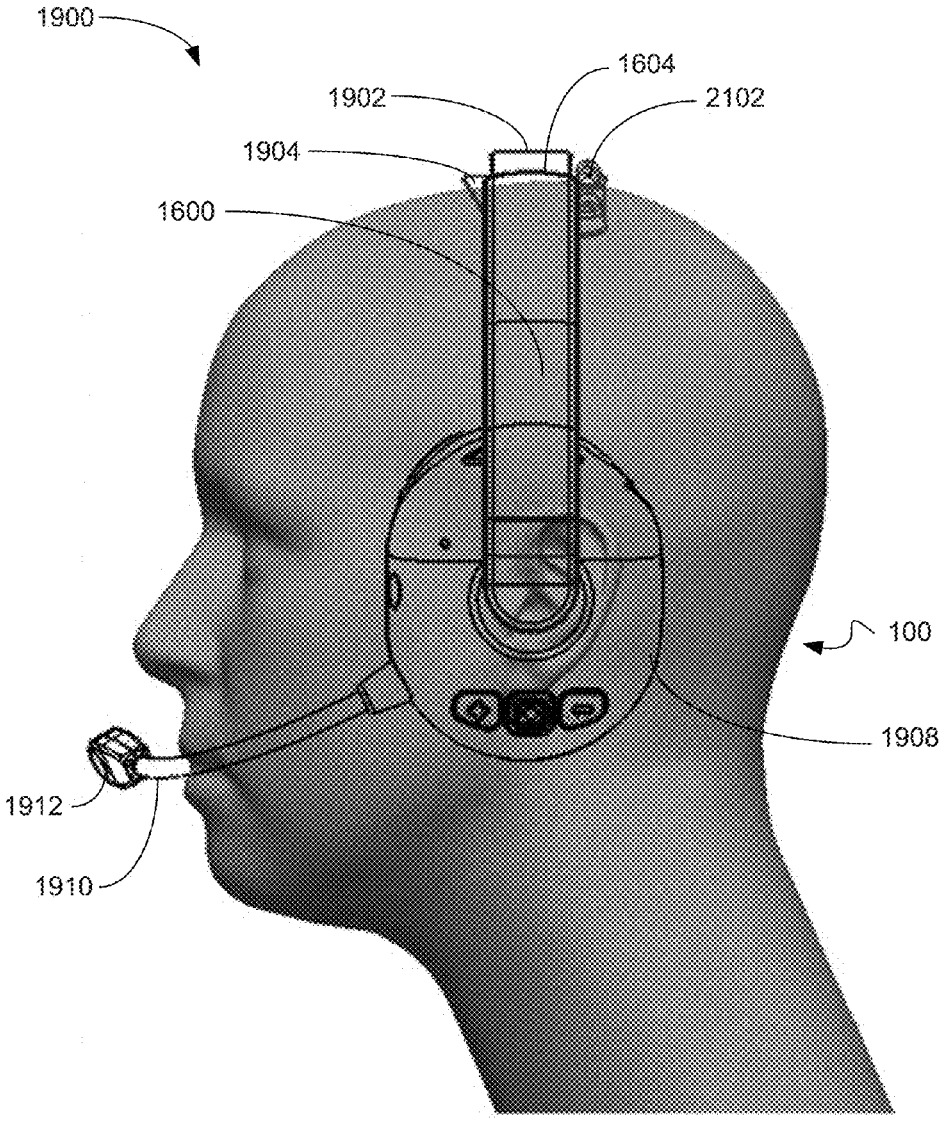
FIG. 21 is a side elevation view illustrating an exemplary embodiment of the restricted ball and socket joint for headset ear cup of FIG. 1A used to form a headset in a first configuration, according to a preferred embodiment of the present invention.

FIG. 21 is a side elevation view illustrating an exemplary embodiment of the restricted ball and socket joint for headset ear cup 100 of FIG. 1A used to form a headset 1900 in a first configuration, according to a preferred embodiment of the present invention. Over-the-head portion 1600, 1902, 1600 cannot rotate forward or backward relative to ear cups 1700 and 1908 due to the restricted ball and socket joints for headset ear cups 100.

Figure 22:
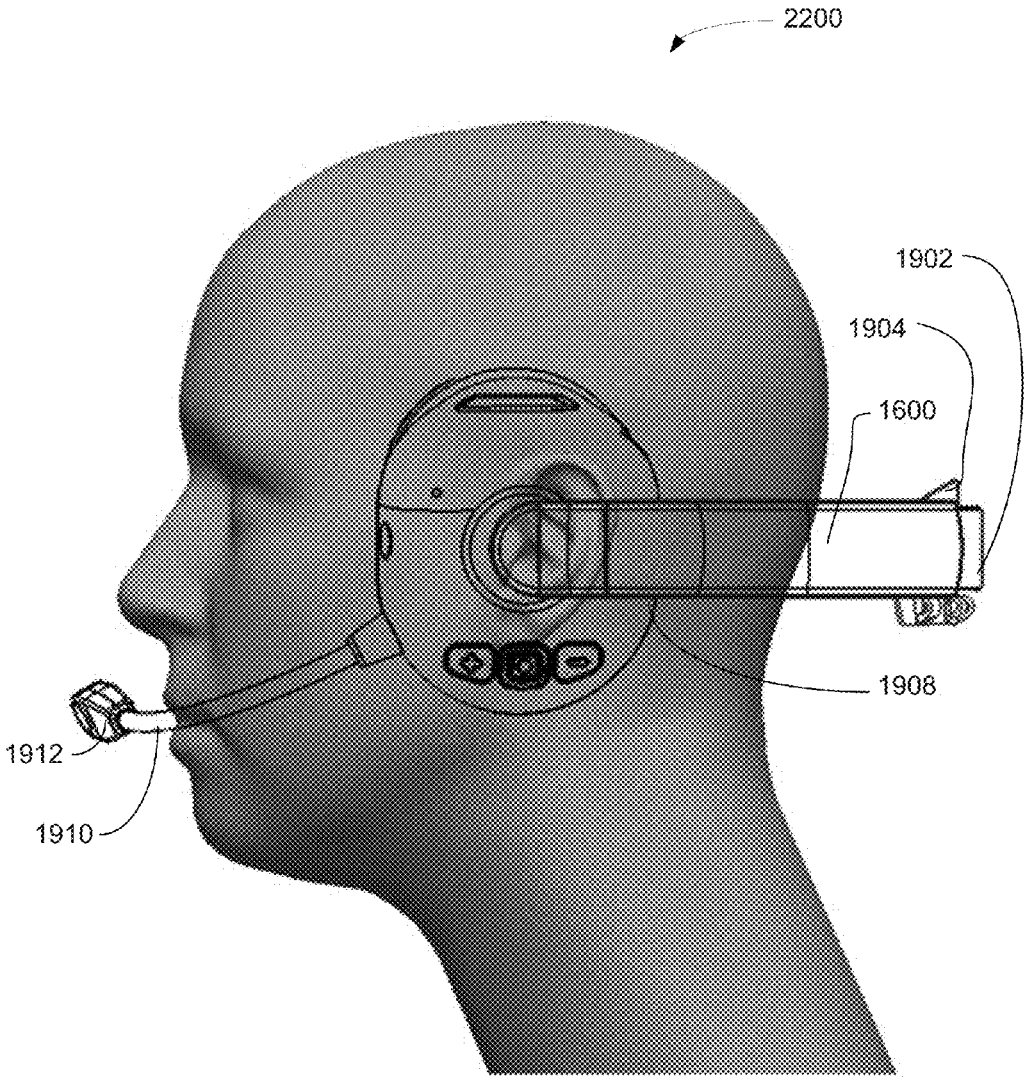
FIG. 22 is a side elevation view illustrating an exemplary embodiment of the restricted ball and socket joint for headset ear cup of FIG. 1A used to form a headset in a second configuration, according to a preferred embodiment of the present invention.
Figure 27:
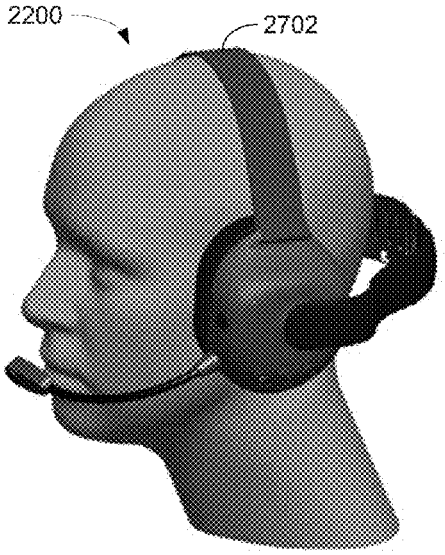
FIG. 27 is a perspective view illustrating an exemplary embodiment of the restricted ball and socket joint for headset ear cup of FIG. 1A integrated into a headset in a second configuration, according to a preferred embodiment of the present invention.

FIG. 22 is a side elevation view illustrating an exemplary embodiment of the restricted ball and socket joint for headset ear cup 100 of FIG. 1A used to form a headset 1900 in a second configuration 2200, according to a preferred embodiment of the present invention. Over-the-head portion 1600, 1902, 1600 cannot rotate forward or backward relative to ear cups 1700 and 1908 due to the restricted ball and socket joints for headset ear cups 100. In order to transition from the first configuration 1900 shown in FIG. 21 to the second configuration 2200 shown in FIG. 22, both of the restricted ball and socket joints for headset ear cups 100 must be disconnected (see FIGS. 13A to 15B), reoriented to the ear cups 1700 and 1908, and re-connected in the second configuration 2200. Between the first and second configurations 1900 and 2200, respectively, there are no intermediate configurations as grooves 112 of irregular ball 118 only align to ridges 110 of socket 120 at ninety degree intervals. The second configuration 2200 shown in FIG. 22 preferably includes a head strap 2702, as shown in FIG. 27, for supporting the weight of the headset 1900 in configuration 2200.

Figure 23:
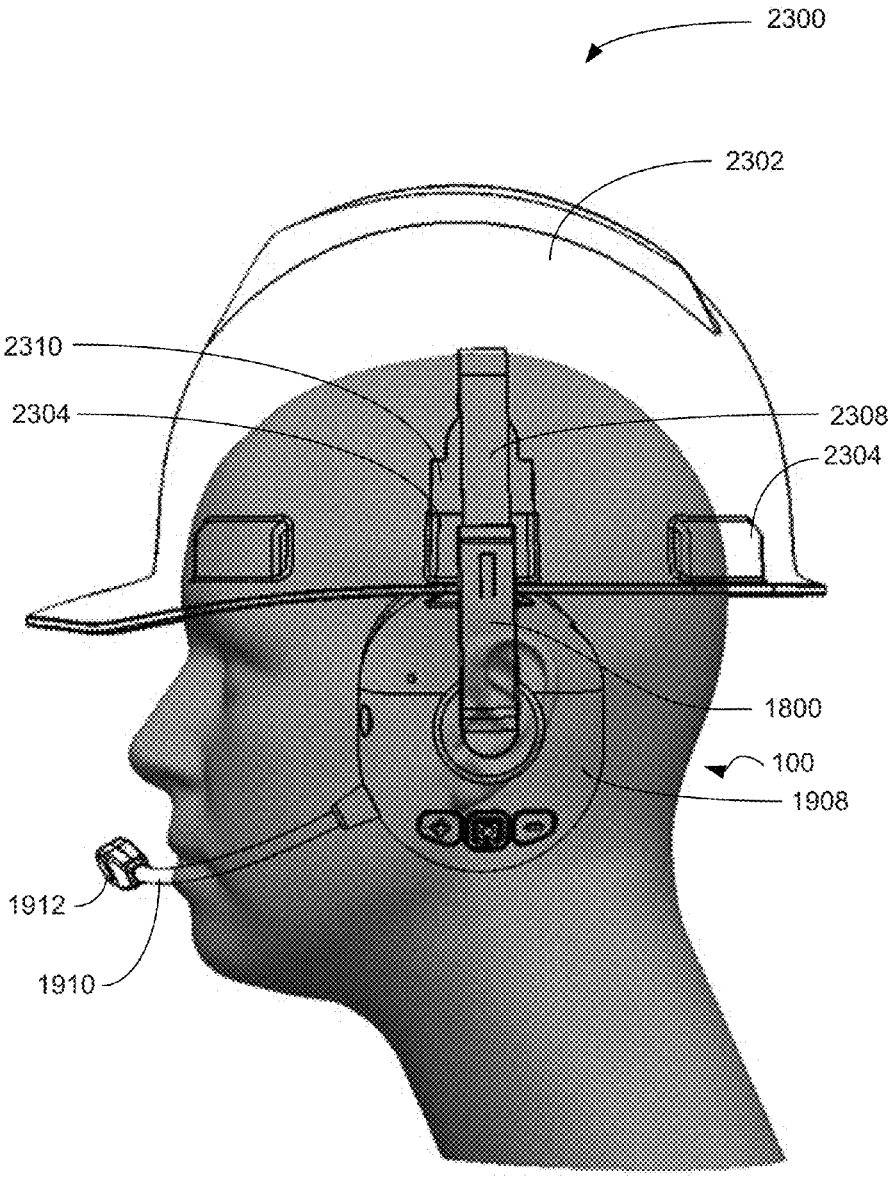
FIG. 23 is a side elevation view illustrating an exemplary embodiment of the restricted ball and socket joint for headset ear cup of FIG. 1A used to form a helmet headset, according to a preferred embodiment of the present invention.

FIG. 23 is a side elevation view illustrating an exemplary embodiment of the restricted ball and socket joint for headset ear cup 100 of FIG. 1A used to form a helmet headset 2300, according to a preferred embodiment of the present invention. Helmet 2302 has a plurality of connection points 2304, one of which, on each side of helmet 2302, is aligned to the wearer's ear. A coupling 2310 is inserted into each ear-aligned connection point 2304 which couples to a bent support 2308 which connects to helmet mounted side piece 1800 that includes irregular ball 118. Irregular ball 118 is inserted into socket 120 of ear cup 2306 to allow restricted rotation top-to-bottom and front-to-back to achieve a good fit regardless of head shape or size.

Figure 24:
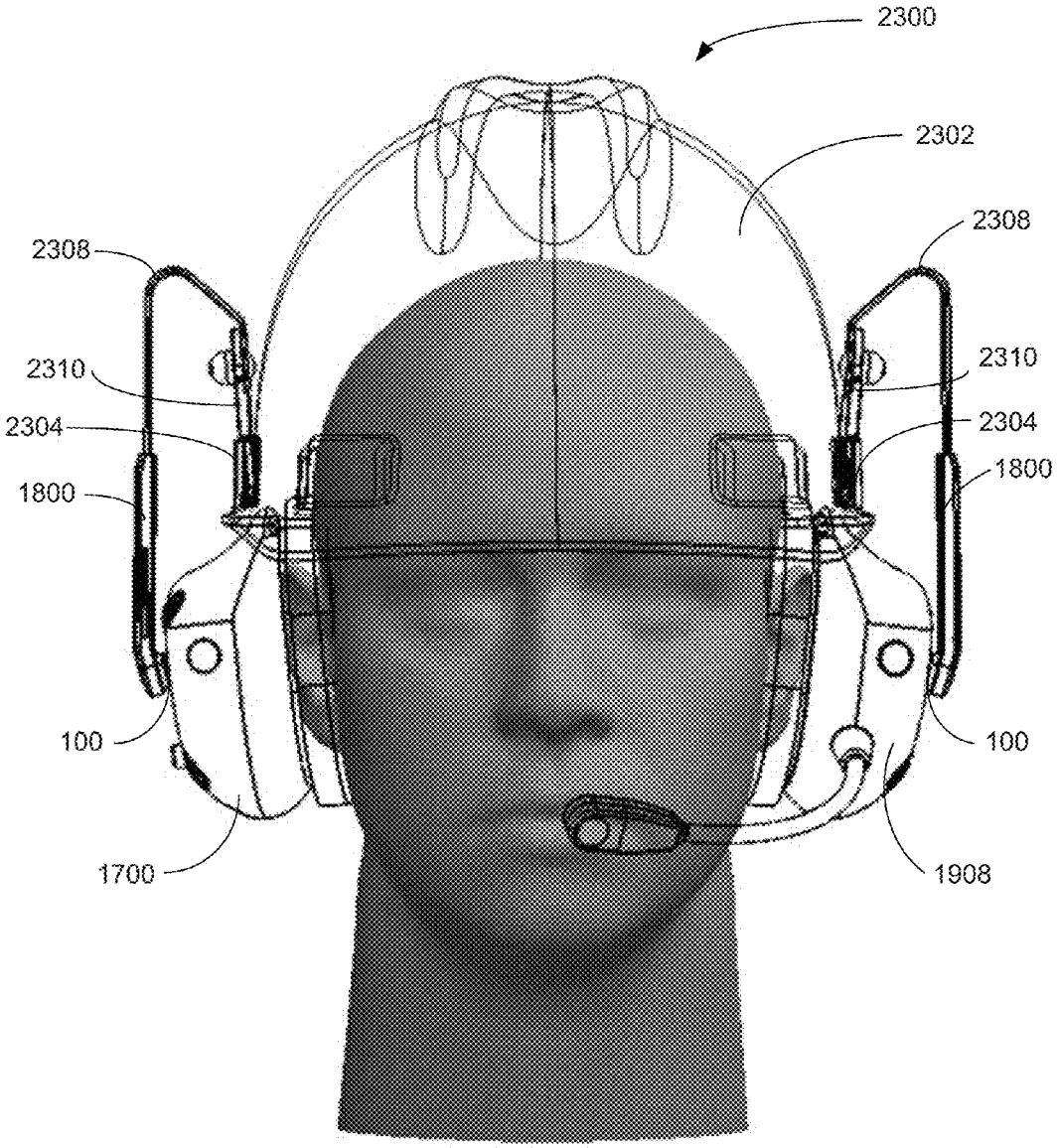
FIG. 24 is a front elevation view illustrating an exemplary embodiment of the restricted ball and socket joint for headset ear cup of FIG. 1A used to form a helmet headset, according to a preferred embodiment of the present invention.

FIG. 24 is a front elevation view illustrating an exemplary embodiment of the restricted ball and socket joint for headset ear cup 100 of FIG. 1A used to form a helmet headset 2300, according to a preferred embodiment of the present invention. Bent support 2308 and coupling 2304 can be more clearly seen in this view.

Figure 25:
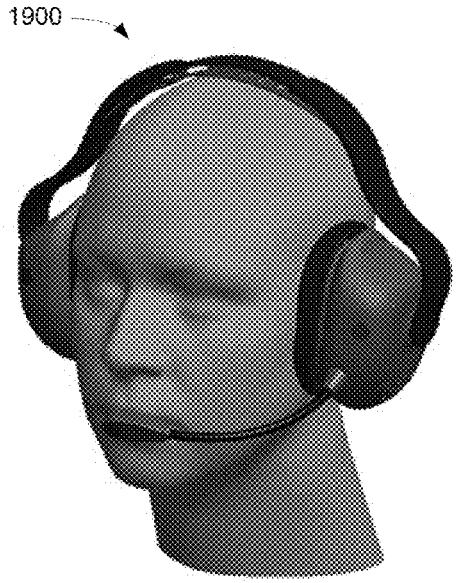
FIG. 25 is a perspective view illustrating an exemplary embodiment of an irregular ball of the restricted ball and socket joint for headset ear cup of FIG. 1A integrated into a headset in a first configuration, according to a preferred embodiment of the present invention.

FIG. 25 is a perspective view illustrating an exemplary embodiment of the restricted ball and socket joint for headset ear cup 100 of FIG. 1A integrated into a headset 1900 in a first configuration, according to a preferred embodiment of the present invention. The invention does not require that the user is bald.

Figure 26:
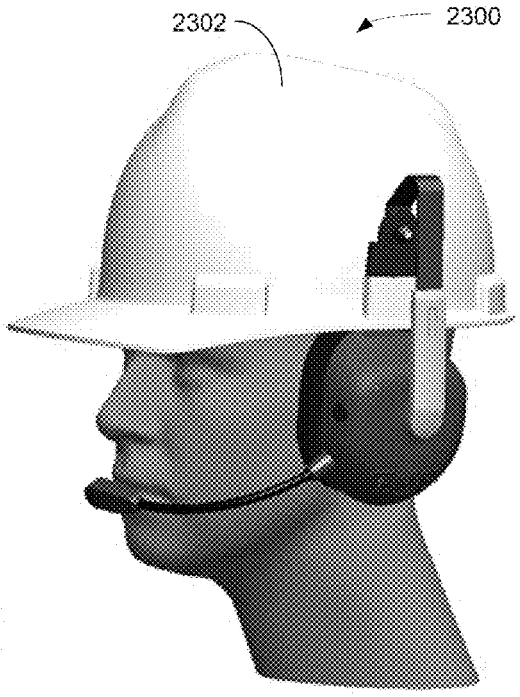
FIG. 26 is a perspective view illustrating an exemplary embodiment of an irregular ball of the restricted ball and socket joint for headset ear cup of FIG. 1A integrated into a helmet headset, according to a preferred embodiment of the present invention.

FIG. 26 is a perspective view illustrating an exemplary embodiment of a ball of the restricted ball and socket joint for headset ear cup 100 of FIG. 1A integrated into a helmet headset, according to a preferred embodiment of the present invention. Helmets 2302 of various shapes and styles may be adapted to support the helmet headset 2300.

FIG. 27 is a perspective view illustrating an exemplary embodiment of the restricted ball and socket joint for headset ear cup 100 of FIG. 1A integrated into a headset in a second configuration, according to a preferred embodiment of the present invention. Head strap 2702 is preferably made of a comfortable fabric.

Figure 28:
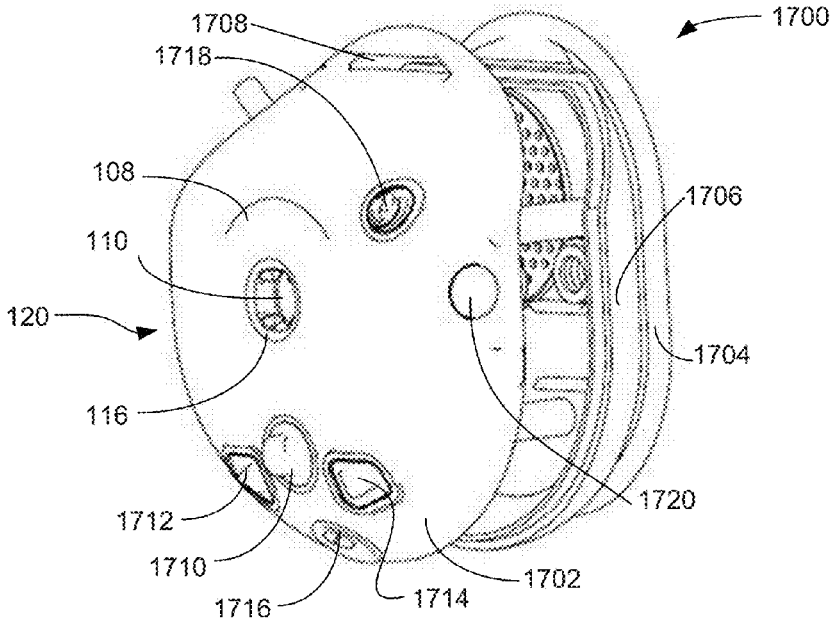
FIG. 28 is a perspective partially exploded view illustrating an exemplary embodiment of the restricted ball and socket joint for headset ear cup of FIG. 17, according to a preferred embodiment of the present invention.

FIG. 28 is a perspective partially exploded view illustrating an exemplary embodiment of the restricted ball and socket joint for headset ear cup 1700 of FIG. 17, according to a preferred embodiment of the present invention. This view more clearly shows the boundary between bottom panel 1706 and top panel 1702.

Figure 29:
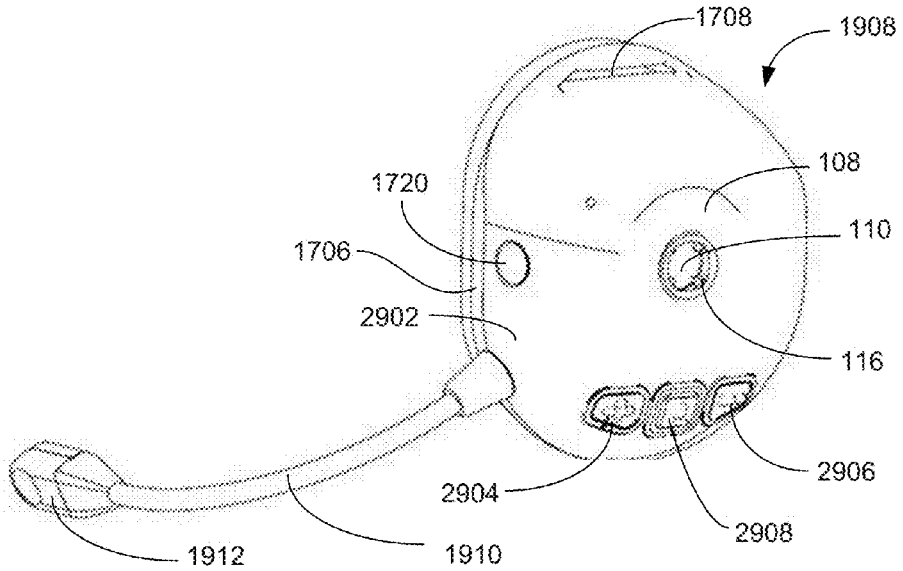
FIG. 29 is a perspective view illustrating an exemplary embodiment of the restricted ball and socket joint for headset ear cup of FIG. 19, according to a preferred embodiment of the present invention.

FIG. 29 is a perspective view illustrating an exemplary embodiment of the restricted ball and socket joint for headset ear cup 1908 of FIG. 19, according to a preferred embodiment of the present invention. Shell 2902 differs from shell 1702 in that it is left-handed and accommodates boom microphone 1910, volume up button 2906, volume down button 2906, and menu/answer button 2908.

The embodiments described above are merely exemplary. Such examples are limited only by the claims below in light of the specification above. Those of skill in the art, enlightened by the present disclosure, will understand the variety of ways that restricted ball and socket joints may be used to ensure useful limitations in the motion of ball and socket joints.

We claim:

1. A restricted ball and socket joint for a headset ear cup comprising:

a. an irregular ball comprising:
   i. a bulb;
   ii. an axis of radial symmetry;
   iii. a plurality of axial external grooves equally spaced apart around said bulb;
   iv. a stem extending between said bulb and an object to be connected by said restricted ball and socket joint;
   v. a semi-spherical section extending axially from said stem, wherein said semi-spherical section comprises the largest diameter of said bulb;
   vi. a truncated conical section extending axially from said semi-spherical section;

b. a socket comprising:
   i. a circular opening having a central axis of rotation;
   ii. a plurality of ridges within said circular opening alignable to said plurality of said grooves;
   iii. a beveled annular edge surrounding said circular opening;
   iv. an inner opposing beveled surface extending axially from said beveled annular edge; and
   v. an inner cylindrical surface extending axially from said inner opposing beveled surface:

c. wherein said irregular ball, when installed in said socket, is restricted from rotating about said central axis of rotation by said plurality of said ridges engaging said plurality of said grooves;

d. wherein said irregular ball is installed in said socket only in discrete positions determined by the number and spacing of said grooves and ridges; and e. wherein said inner cylindrical surface of said socket and said truncated conical section of said ball form a predetermined angle, when said ball is installed in said socket and said axis of radial symmetry of said irregular ball is aligned with said central axis of rotation of said socket, wherein said predetermined angle determines a limit of rotation of said irregular ball about axes orthogonal to said central axis of rotation of said socket.

2. The restricted ball and socket joint for a headset ear cup of claim 1, further comprising a panel that is one of supporting said socket and of one piece with said socket.

3. The restricted ball and socket joint for a headset ear cup of claim 1, wherein said irregular ball further comprises a semi-spherical end piece extending axially from said truncated conical section.

4. The restricted ball and socket joint for a headset ear cup of claim 3, wherein said semi-spherical end piece of said irregular ball comprises an axially aligned concave portion.

5. The restricted ball and socket joint for a headset ear cup of claim 3, wherein said socket further comprises an inner semi-spherical section extending axially from said inner cylindrical surface.

6. The restricted ball and socket joint for a headset ear cup of claim 5, wherein each ridge of said plurality of said ridges have a generally triangular cross-section and taper bi-directionally from a junction of said inner opposing beveled surface and said inner cylindrical surface.

7. The restricted ball and socket joint for a headset ear cup of claim 5, wherein said inner cylindrical surface of said socket and said truncated conical section of said ball form a predetermined angle, when said ball is installed in said socket and said axis of radial symmetry of said irregular ball is aligned with said central axis of rotation of said socket, wherein said predetermined angle determines the limit of rotation of said irregular ball about axes orthogonal to said central axis of rotation of said socket.

8. The restricted ball and socket joint for a headset ear cup of claim 7, wherein said predetermined angle is twenty degrees.

9. The restricted ball and socket joint for a headset ear cup of claim 5, wherein a first said irregular ball is one of connected to a first headset side piece and of one piece with a first headset side piece.

10. The restricted ball and socket joint for a headset ear cup of claim 5, wherein a first said irregular ball is one of connected to a first helmet side piece and of one piece with a first helmet side piece.

11. The restricted ball and socket joint for a headset ear cup of claim 5, wherein said socket is one of fixed in a shell of a headset ear cup and of one piece with a shell of a headset ear cup.

12. The restricted ball and socket joint for a headset ear cup of claim 5, wherein;

a. a first said irregular ball is integral to a first headset side piece at a first end of said first headset side piece;

b. a second said irregular ball is integral to a second headset side piece at a first end of said second headset side piece;

c. said first and second headset side pieces are connected by an adjustment band;

d. a first socket is integral with a shell of a first headset ear cup;

e. a second socket is integral with a shell of a second headset ear cup;

f. said first irregular ball is installed in said first socket; and g. said second irregular ball is installed in said second socket to form a headset.

13. The restricted ball and socket joint for a headset ear cup of claim 12, wherein said first and second irregular balls are installed in said first and second sockets, respectively, only in discrete positions determined by the number and spacing of said grooves and said ridges.

14. The restricted ball and socket joint for a headset ear cup of claim 5, wherein;

a. a first said irregular ball is integral with a first helmet headset side piece at a first end of said first helmet headset side piece;

b. a second said irregular ball is integral with a second helmet headset side piece at a first end of second helmet headset side piece;

c. said first and second helmet headset side pieces are connected to first and second bent supports, respectively, that are coupled to first and second helmet couplings, respectively, that are coupled to first and second opposing helmet attachment points, respectively, on a helmet;

d. a first said socket is integral with a shell of a first said headset ear cup;

e. a second said socket is integral with a shell of a second said headset ear cup;

f. said first irregular ball is installed in said first socket; and g. said second irregular ball is installed in said second socket to form a helmet headset.

15. The restricted ball and socket joint for a headset ear cup of claim 14, wherein said first and second irregular balls are installed in said first and second sockets, respectively, only in discrete positions determined by the number and spacing of said grooves and ridges.

16. The restricted ball and socket joint for a headset ear cup of claim 1, wherein said socket further comprises:

an inner semi-spherical section extending axially from said inner cylindrical surface.

17. A restricted ball and socket joint for a headset ear cup comprising:

a. an irregular ball comprising:

i. a bulb;

ii. a stem extending between said bulb and an object to be connected by said restricted ball and socket joint;

iii. an axis of radial symmetry;

iv. a plurality of axial external grooves equally spaced apart around said bulb;

v. a semi-spherical section extending axially from said stem, wherein said semi-spherical section comprises the largest diameter of said bulb;

vi. a truncated conical section extending axially from said semi-spherical section; and vii. a semi-spherical end piece extending axially from said truncated conical section;

b. a socket comprising:

i. a panel;

ii. a circular opening in said panel having a central axis of rotation;

iii. a beveled annular edge of said panel surrounding said circular opening;

iv. an inner opposing beveled surface extending axially from said beveled annular edge;

v. an inner cylindrical surface extending axially from said inner opposing beveled surface;

vi. an inner semi-spherical section extending axially from said inner cylindrical surface;

vii. a plurality of ridges within said circular opening wherein each ridge of said plurality of ridges comprises:

1. a triangular cross-section;

2. extension from said inner opposing beveled surface and said inner cylindrical surface;

3. a bidirectional taper extending from a junction of said inner opposing beveled surface and said inner cylindrical surface;

4. said plurality of ridges alignable to said plurality of said grooves;

c. wherein said irregular ball, when installed in said socket, is restricted from rotating about said central axis of rotation by said plurality of said ridges engaging said plurality of said grooves;

d. wherein said irregular ball is installed in said socket only in discrete positions determined by the number and spacing of said grooves and ridges; and e. wherein said inner cylindrical surface of said socket and said truncated conical section of said ball form a predetermined angle, when said ball is installed in said socket and said axis of radial symmetry of said irregular ball is aligned with said central axis of rotation of said socket, wherein said predetermined angle determines the limit of rotation of said irregular ball about axes orthogonal to said central axis of rotation of said socket.

18. The restricted ball and socket joint for a headset ear cup of claim 17, further comprising one of:

a. said headset ear cup, further comprising:
   i. a first said irregular ball integral with a first headset side piece at a first end of said first headset side piece;
   ii. a second said irregular ball integral with a second headset side piece at a first end of said second headset side piece;
   iii. said first and second headset side pieces are connected by an adjustment band;
   iv. a first said socket integral with a shell of a first said headset ear cup;
   v. a second said socket integral with a shell of a second said headset ear cup;
   vi. said first irregular ball installed in said first said socket;
   vii. said second irregular ball installed in said second said socket to form a headset; and
   viii. wherein said first and second irregular balls are installed in said first and second sockets, respectively, only in discrete positions determined by the number and spacing of said grooves and ridges; and b. said headset ear cup, further comprising:
   i. a first said irregular ball integral with a first helmet headset side piece at a first end of said first helmet headset side piece;
   ii. a second said irregular ball integral with a second helmet headset side piece at a first end of said second helmet headset side piece;
   iii. said first and second helmet headset side pieces connected to first and second bent supports, respectively, that are coupled to first and second helmet couplings, respectively, that are coupled to first and second opposing helmet attachment points, respectively, on a helmet;
   iv. a first socket integral with a shell of a first said headset ear cup;
   v. a second socket integral with a shell of a second said headset ear cup;
   vi. said first irregular ball installed in said first socket;
   vii. said second irregular ball is installed in said second socket to form a helmet headset; and
   viii. wherein said first and second irregular balls are installed in said first and second sockets, respectively, only in discrete positions determined by the number and spacing of said grooves and ridges.

19. A restricted ball and socket joint for a headset ear cup comprising:

a. an irregular ball comprising:
   i. a bulb;
   ii. a stem extending between said bulb and an object to be connected by said restricted ball and socket joint;
   iii. an axis of radial symmetry;
   iv. a plurality of axial external grooves equally spaced apart around said bulb;
   v. a semi-spherical section extending axially from said stem, wherein said semi-spherical section comprises the largest diameter of said bulb;
   vi. a truncated conical section extending axially from said semi-spherical section; and
   vii. a semi-spherical end piece extending axially from said truncated conical section;

b. a socket comprising:
   i. a panel;
   ii. a circular opening in said panel having a central axis of rotation;
   iii. a beveled annular edge of said panel surrounding said circular opening;
   iv. an inner opposing beveled surface extending axially from said beveled annular edge;
   v. an inner cylindrical surface extending axially from said inner opposing beveled surface;
   vi. an inner semi-spherical section extending axially from said inner cylindrical surface;
   vii. a plurality of ridges within said circular opening wherein each ridge of said plurality of ridges comprises:
      1. a triangular cross-section;
      2. extension from said inner opposing beveled surface and said inner cylindrical surface;
      3. a bidirectional taper extending from a junction of said inner opposing beveled surface and said inner cylindrical surface;
      4. said plurality of ridges alignable to said plurality of said grooves;

c. wherein said irregular ball, when installed in said socket, is restricted from rotating about said central axis of rotation by said plurality of said ridges engaging said plurality of said grooves;

d. wherein said irregular ball is installed in said socket only in discrete positions determined by the number and spacing of said grooves and ridges; and e. wherein said inner cylindrical surface of said socket and said truncated conical section of said ball form a predetermined angle, when said ball is installed in said socket and said axis of radial symmetry of said irregular ball is aligned with said central axis of rotation of said socket, wherein said predetermined angle determines the limit of rotation of said irregular ball about axes orthogonal to said central axis of rotation of said socket.

20. The restricted ball and socket joint for a headset ear cup of claim 19, wherein said semi-spherical end piece of said irregular ball comprises an axially aligned concave portion.

* * * * *